US007931072B1

(12) United States Patent
Kroliczek et al.

(10) Patent No.: US 7,931,072 B1
(45) Date of Patent: Apr. 26, 2011

(54) HIGH HEAT FLUX EVAPORATOR, HEAT TRANSFER SYSTEMS

(75) Inventors: Edward J. Kroliczek, Davidsonville, MD (US); Dmitry Khrustalev, Woodstock, MD (US); Michael J. Morgan, Arcanum, OH (US)

(73) Assignee: Alliant Techsystems Inc., Minneapolis, MN (US)

( * ) Notice: Subject to any disclaimer, the term of this patent is extended or adjusted under 35 U.S.C. 154(b) by 1254 days.

(21) Appl. No.: 11/383,740

(22) Filed: May 16, 2006

Related U.S. Application Data

(63) Continuation-in-part of application No. 10/676,265, filed on Oct. 2, 2003.

(60) Provisional application No. 60/681,479, filed on May 17, 2005, provisional application No. 60/415,424, filed on Oct. 2, 2002.

(51) Int. Cl.
*F28D 15/00* (2006.01)

(52) U.S. Cl. ..... 165/104.26; 165/104.21

(58) Field of Classification Search ..... 165/104.21, 165/104.26, 274
See application file for complete search history.

(56) References Cited

U.S. PATENT DOCUMENTS

| | | | |
|---|---|---|---|
| 3,490,718 | A | 1/1970 | Vary |
| 3,613,778 | A | 10/1971 | Feldman, Jr. |
| 3,661,202 | A | 5/1972 | Moore, Jr. |
| 3,677,336 | A | 7/1972 | Moore, Jr. |
| 3,734,173 | A | 5/1973 | Moritz |
| 3,756,903 | A | 9/1973 | Jones |
| 3,792,318 | A | 2/1974 | Fries et al. |
| 3,803,688 | A | 4/1974 | Peck |
| 3,884,293 | A | 5/1975 | Pessolano et al. |
| 4,005,297 | A | 1/1977 | Cleaveland |
| 4,046,190 | A | 9/1977 | Marcus et al. |
| 4,087,893 | A | 5/1978 | Sata et al. |
| 4,116,266 | A | 9/1978 | Sawata et al. |
| 4,170,262 | A | 10/1979 | Marcus et al. |

(Continued)

FOREIGN PATENT DOCUMENTS

DE 19941398 8/2000

(Continued)

OTHER PUBLICATIONS

Baumann, Jane, et al., "A methodology for enveloping reliable start-up of LHPs," AIAA Paper 2000-2285 (AIAA Accession No. 33681), AIAA Thermophysics Conference, 34th, Denver, CO, Jun. 19-22, 2000.

(Continued)

*Primary Examiner* — Ljiljana (Lil) V Ciric
(74) *Attorney, Agent, or Firm* — TraskBritt

(57) ABSTRACT

An evaporator includes an outer fluid enclosure, a liquid inlet port extending through the outer fluid enclosure, a liquid-distribution structure, a wick, and a vapor removal channel. The liquid-distribution structure is joined to the outer fluid enclosure to form a fluidly sealed hermetic chamber. The liquid-distribution structure includes a vapor barrier wall having an outer heat-receiving surface and the liquid-distribution structure is configured to distribute liquid over an inner surface of the vapor barrier wall. The wick is positioned inside the fluidly sealed hermetic chamber and is coupled to a liquid inlet port. The vapor removal channel is defined by and is in fluid communication with the wick and the liquid-distribution structure, and is near the outer heat-receiving surface of the vapor barrier wall. A thermal conductance of the liquid-distribution structure is higher than a thermal conductance of the wick.

45 Claims, 31 Drawing Sheets

U.S. PATENT DOCUMENTS

| | | | | | |
|---|---|---|---|---|---|
| 4,467,861 | A | | 8/1984 | Kiseev et al. | |
| 4,470,450 | A | | 9/1984 | Bizzell et al. | |
| 4,470,451 | A | * | 9/1984 | Alario et al. | 165/104.26 |
| 4,503,483 | A | | 3/1985 | Basiulis | |
| 4,685,512 | A | | 8/1987 | Edelstein et al. | |
| 4,770,238 | A | | 9/1988 | Owen | |
| 4,819,719 | A | | 4/1989 | Grote et al. | |
| 4,854,379 | A | | 8/1989 | Shaubach et al. | |
| 4,862,708 | A | | 9/1989 | Basiulis | |
| 4,869,313 | A | | 9/1989 | Fredley | |
| 4,883,116 | A | | 11/1989 | Seidenberg et al. | |
| 4,890,668 | A | | 1/1990 | Cima | |
| 4,898,231 | A | * | 2/1990 | Miyazaki | 165/274 |
| 4,899,810 | A | * | 2/1990 | Fredley | 165/104.26 |
| 4,934,160 | A | | 6/1990 | Mueller | |
| 5,002,122 | A | | 3/1991 | Sarraf et al. | |
| 5,016,705 | A | | 5/1991 | Bahrie et al. | |
| 5,103,897 | A | | 4/1992 | Cullimore et al. | |
| 5,303,768 | A | | 4/1994 | Alario et al. | |
| 5,335,720 | A | | 8/1994 | Ogushi et al. | |
| 5,642,776 | A | | 7/1997 | Meyer, IV et al. | |
| 5,725,049 | A | | 3/1998 | Swanson et al. | |
| 5,761,037 | A | | 6/1998 | Anderson et al. | |
| 5,769,154 | A | * | 6/1998 | Adkins et al. | 165/104.26 |
| 5,771,967 | A | | 6/1998 | Hyman | |
| 5,816,313 | A | | 10/1998 | Baker | |
| 5,842,513 | A | | 12/1998 | Maciaszek et al. | |
| 5,899,265 | A | | 5/1999 | Schneider et al. | |
| 5,944,092 | A | | 8/1999 | Van Oost | |
| 5,947,193 | A | * | 9/1999 | Adkins et al. | 165/104.26 |
| 5,950,710 | A | | 9/1999 | Liu | |
| 5,966,957 | A | | 10/1999 | Malhammar et al. | |
| 6,058,711 | A | | 5/2000 | Maciaszek et al. | |
| 6,227,288 | B1 | | 5/2001 | Gluck et al. | |
| 6,330,907 | B1 | | 12/2001 | Ogushi et al. | |
| 6,381,135 | B1 | | 4/2002 | Prasher et al. | |
| 6,382,309 | B1 | | 5/2002 | Kroliczek et al. | |
| 6,415,627 | B1 | | 7/2002 | Pfister et al. | |
| 6,450,132 | B1 | | 9/2002 | Yao et al. | |
| 6,450,162 | B1 | | 9/2002 | Wang et al. | |
| 6,533,029 | B1 | | 3/2003 | Phillips | |
| 6,591,902 | B1 | | 7/2003 | Trent | |
| 6,615,912 | B2 | | 9/2003 | Garner | |
| 6,626,231 | B2 | | 9/2003 | Cluzet et al. | |
| 6,810,946 | B2 | | 11/2004 | Hoang | |
| 6,840,304 | B1 | | 1/2005 | Kobayashi et al. | |
| 6,889,754 | B2 | | 5/2005 | Kroliczek et al. | |
| 7,004,240 | B1 | | 2/2006 | Kroliczek et al. | |
| 7,051,794 | B2 | | 5/2006 | Luo | |
| 7,251,889 | B2 | | 8/2007 | Kroliczek et al. | |
| 7,549,461 | B2 | | 6/2009 | Kroliczek et al. | |
| 7,775,261 | B2 | * | 8/2010 | Valenzuela | 165/104.26 |
| 7,823,629 | B2 | * | 11/2010 | Rosenfeld et al. | 165/104.26 |
| 2002/0062648 | A1 | | 5/2002 | Ghoshal | |
| 2004/0182550 | A1 | | 9/2004 | Kroliczek et al. | |
| 2004/0206479 | A1 | | 10/2004 | Kroliczek et al. | |

FOREIGN PATENT DOCUMENTS

| | | | |
|---|---|---|---|
| EP | 0210337 | | 2/1987 |
| EP | 0987509 | A1 | 3/2000 |
| JP | 63036862 | | 3/1988 |
| JP | 2000055577 | | 2/2000 |
| JP | 2000241089 | | 9/2000 |
| RU | 2098733 | | 3/1995 |
| SU | 505858 | | 5/1976 |
| SU | 1467354 | | 1/1987 |
| SU | 1834470 | A1 | 7/1995 |
| WO | 0210661 | A1 | 2/2003 |
| WO | 03054469 | | 7/2003 |
| WO | 2004031675 | | 4/2004 |
| WO | 2004040218 | | 5/2004 |
| WO | 2005043059 | | 5/2005 |

OTHER PUBLICATIONS

Bienert, W.B., et al., "The Proof-of-Feasibility of Multiple Evaporator Loop Heat Pipes," 6th European Symposium on Environmental Systems, May 1997, 6 pages.

Bugby, D., et al., "Across-Gimbal and Miniaturized Cryogenic Loop Heat Pipes," CP654, Space Technology and Applicatons International Forum-STAIF 2003, edited by M.S. El-Genk, American Institute of Physics, 2003, pp. 218-226.

Bugby, D., et al., "Advanced Components and Techniques for Cryogenic Integration," Environmental systems-International conference; 31st Society of Automotive Engineers New York, 2001-01-2378, Orlando, FL; Jul. 2001, 9 pages.

Bugby, D., et al., "Advanced Components and Techniques for Cryogenic Integration," presented at 2002 Spacecraft Thermal Control Symposium by Swales Aerospace, El Segundo, CA, Mar. 2002, 14 pages.

Bugby, D., et al., "Advanced Components for Cryogenic Integration," Cryocoolers 12, edited by R.G. Ross, Jr., Kluwer Academic/Plenum Publishers, 2003, pp. 693-708.

Bugby, D., et al., "Advanced Components for Cryogenic Integration," Proceedings of the 12th International Cryocooler Conference held Jun. 18-20, 2002, in Cambridge, MA, 15 pages.

Bugby, D., et al., "Development and Testing of a Gimbal Thermal Transport System," Proceedings of the 11th International Cryocooler Conference held Jun. 20-22, 2000, in Keystone, Colorado, 11 pages.

Bugby, D., et al., "Development of Advanced Cryogenic Integration Solutions," presented at the 10th International Cryocoolers Conference on May 26-28, 1998, in Monterey, CA, and published in "Cryocoolers 10," by Ron Ross, Jr., Kluwer Academic/Plenum Publishers, NY 1999, 17 pages.

European Search Report (Application No. EP 04 01 6584) dated May 15, 2006 (4 total pages).

Hoang, "Advanced Capillary Pumped Loop (A-CPL) Project Summary," Contract No. NAS5-98103, Mar. 1994, pp. 1-37.

Hoang, Triem T., "Design and Test of a Proof-of-Concept Advanced Capillary Pumped Loop," Society of Automotive Engineers, presented at the 27th Environmental Systems International Conference, New York, 1997, Paper 972326, 6 pages.

Hoang, Trung T., et al., "Development of an Advanced Capillary Pumped Loop," Society of Automotive Engineers, presented at the 27th Environmental Systems International Conference, New York, 1997, Paper 972325, 6 pages.

Kotlyarov, E. Yu, et al., "Methods of Incrase of the Evaporators Reliability for Loop Heat Pipes and Capillary Pumped Loops," 24th International Conference on Environmental Systems, Jun. 20-23, 1994, 15 pages.

Ku, J., "Recent Advances in Capillary Pumped Loop Technology," 1997 National Heat Transfer Conference, Baltimore, MD, Aug. 10-12, 1997, AIAA 97-3870, 22 pages.

Ku, J., et al., "A high power spacecraft thermal management system," AIAA-1988-2702, Thermophysics, Plasmadynamics and Lasers Conference, San Antonio, TX Jun. 27-29, 1988, 12 pages.

Ku, J., et al., "An Improved High Power Hybrid Capillary Pumped Loop," paper submitted to SAE 19th Intersociety Conference on Environment Systems, SAE 891566, San Diego, CA, Jul. 24-27, 1989, 10 pages.

Ku, J., et al., "Testing of a Capillary Pumped Loop with Multiple Parallel Starter Pumps," SAE Paper No. 972329, 1997.

Ku, J., et al., "The Hybrid Capillary Pumped Loop," paper submitted to SAE 18th Intersociety Conference on Environmental Systems, SAE 881083, San Francisco, CA, Jul. 11-13, 1988, 11 pages.

Ku, Jentung, "Operational Characteristics of Loop Heat Pipes," NASA Goddard Space Flight Center; SAE Paper 99/01/2007, 29th International Conference on Environmental Systems, Denver, Colorado, Jul. 12-15, 1999; Society of Automotive Engineers, Inc.

McCabe, Michael E., Jr., et al., "Design and Testing of a High Power Spacecraft Thermal Management System," National Aeronautics and Space Administration (NASA), NASA Technical Memorandum 4051, Scientific and Technical Information Division, 1988, 107 pages.

O'Connell, et al., "Hydrogen Loop Pipe Design & Test Results," presented at 2002 Spacecraft Thermal Control Symposium by TTH Research, El Segundo, CA, Mar. 2002, 14 pages.

Van Oost et al., "Design and Experimental Results of the HPCPL," ESTEC CPL-96 Workshop, Noordwijk, Netherlands, 1996, 19 pages.

Van Oost, Stephane, et al., "Test Results of Reliable and Very High Capillary Multi-Evaporators/Condenser Loop," 25th International Conference on Environmental Systems, Jul. 10-13, 1995, 12 pages.
Yun, James, et al., "Development of a Cryogenic Loop Heat Pipe (CLHP) for Passive Optical Bench Cooling Applications," 32nd International Conference on Environmental Systems (ICES-2002), Society of Automotive Engineers Paper No. 2002-01-2507, San Antonio, Texas, 2002, 9 pages.
Yun, James, et al., "Multiple Evaporator Loop Heat Pipe," Society of Automotive Engineers, 2000-01-2410, 30th International Conference on Environmental Systems, Jul. 10-13, 2000, 10 pages.
Yun, S., et al., "Design and Test Results of Multi-Evaporator Loop Heat Pipes," SAE Paper No. 1999-01-2051, 29th International Conference on Environmental Systems, Jul. 1999, 7 pages.

* cited by examiner

HIGH HEAT FLUX EVAPORATOR, HEAT TRANSFER SYSTEMS

CROSS-REFERENCE TO RELATED APPLICATIONS

This application claims the benefit of U.S. Provisional Application Ser. No. 60/681,479, filed May 17, 2005, and is a continuation-in-part of U.S. application Ser. No. 10/676,265, filed Oct. 2, 2003, which claimed the benefit of U.S. Provisional Application Ser. No. 60/415,424, filed Oct. 2, 2002. The disclosure of each of these applications is incorporated herein by reference in its entirety.

This application is also related to U.S. application Ser. No. 10/602,022, filed Jun. 24, 2003, now U.S. Pat. No. 7,004,240, issued Feb. 28, 2006, which claims the benefit of U.S. Provisional Application Ser. No. 60/391,006 filed Jun. 24, 2002; and U.S. application Ser. No. 09/896,561, filed Jun. 29, 2001, now U.S. Pat. No. 6,889,754, issued May 10, 2005, which claims the benefit of U.S. Provisional Application Ser. No. 60/215,588 filed Jun. 30, 2000.

TECHNICAL FIELD

This description relates to an evaporator for use in high heat flux applications.

BACKGROUND

Heat transfer systems are used to transport heat from one location (the heat source) to another location (the heat sink). Heat transfer systems can be used in terrestrial or non-terrestrial applications. For example, heat transfer systems can be used in electronic equipment, which often require cooling during operation. Heat transfer systems can also be used in, and integrated with, satellite equipment that operates within zero- or low-gravity environments.

Loop Heat Pipes (LHPs) and Capillary Pumped Loops (CPLs) are examples of passive two-phase loop heat transfer systems. Each includes an evaporator thermally coupled to the heat source, a condenser thermally coupled to the heat sink, fluid that flows between the evaporator and the condenser, and a fluid reservoir for accommodating redistribution or volume changes of the fluid and for heat transfer system temperature control. The fluid within the heat transfer system can be referred to as the working fluid. The evaporator includes a wick that enables liquid flow. Heat acquired by the evaporator is transported to and rejected by the condenser. These systems utilize capillary pressure developed in a fine-pored wick within the evaporator to promote circulation of working fluid from the evaporator to the condenser and back to the evaporator.

SUMMARY

In one general aspect, an evaporator includes an outer fluid enclosure, a liquid inlet port extending through the outer fluid enclosure, a liquid-distribution structure, a wick, and a vapor removal channel. The liquid-distribution structure is joined to the outer fluid enclosure to form a fluidly sealed hermetic chamber. The liquid-distribution structure includes a vapor barrier wall having an outer heat-receiving surface and the liquid-distribution structure is configured to distribute liquid over an inner surface of the vapor barrier wall. The wick is positioned inside the fluidly sealed hermetic chamber and is coupled to the liquid inlet port. The vapor removal channel is defined by, and is in fluid communication with, the wick and the liquid-distribution structure, and is near the outer heat-receiving surface of the vapor barrier wall. A thermal conductance of the liquid-distribution structure is higher than a thermal conductance of the wick.

Implementations may include one or more of the following aspects. For example, the outer fluid enclosure can include a liquid barrier wall positioned such that the wick is between the liquid barrier wall and the liquid-distribution structure. The evaporator can include a liquid flow channel defined between the wick and the liquid barrier wall. The liquid barrier wall can include at least one segment that has a conductivity that is lower than a conductivity of the wick. The liquid barrier wall can be made, at least in part, of MONEL®, stainless steel, ceramic, or plastic. The liquid barrier wall can include at least one segment that is thinner than a remainder of the liquid barrier wall.

The evaporator can include a liquid flow channel positioned adjacent the wick and in fluid communication with the liquid inlet port. The vapor removal channel can be remote from the liquid flow channel. The liquid flow channel can be remote from an outer fluid enclosure. The evaporator can include a sealing device positioned between the outer fluid enclosure and the liquid flow channel. The liquid flow channel can be defined between the sealing device and the wick. The vapor removal channel can be remote from the liquid inlet port.

The liquid-distribution structure can include a porous device. The porous device can include vapor passages and pores having a size sufficient to distribute liquid and be in fluid communication with the vapor passages. The vapor removal channel can be in fluid communication with at least some of the vapor passages of the liquid-distribution structure. The porous device can be bonded to the vapor barrier wall. The porous device can be formed integrally with the vapor barrier wall. The porous device can be made of the same material as the vapor barrier wall. The porous device can be sintered to the vapor barrier wall.

The wick can be in fluid communication with at least a portion of the liquid-distribution structure.

A thickness of the wick can be greater than a thickness of the liquid-distribution structure. The wick and the liquid-distribution structure can contact each other at a region that is smaller than a surface area of the liquid-distribution structure that faces the wick.

The outer fluid enclosure can include a liquid barrier wall and a side wall coupled to the liquid barrier wall. The liquid inlet port can extend through the liquid barrier wall. The liquid inlet port can extend through the side wall.

The evaporator can include a fluid outlet port through the outer fluid enclosure for sweepage of vapor and non-condensable gas within the liquid.

The outer fluid enclosure can be cylindrical, and the liquid-distribution structure and the wick are planar. Or, the outer fluid enclosure can be annular, and the wick and the liquid-distribution structure can be annular.

The liquid-distribution structure can include microchannels along a surface of the vapor bather wall. The vapor removal channel can be in fluid communication with at least some of the liquid-distribution structure microchannels. The microchannels can be formed into the vapor barrier wall at an inner surface of the vapor barrier wall. The wick can be in fluid communication with at least some of the liquid-distribution structure microchannels.

The vapor removal channel can be in direct fluid communication with an evaporation interface defined within the microchannels.

In another general aspect, an evaporator includes a liquid barrier wall, a liquid inlet port through the liquid barrier wall, a liquid-distribution structure, a wick, and one or more vapor removal channels. The liquid-distribution structure includes a vapor barrier wall having an outer heat-receiving surface, vapor passages, and pores having a size sufficient to distribute liquid and being in fluid communication with the vapor passages. The wick is positioned between the liquid barrier wall and the liquid-distribution structure and coupled to the liquid inlet port. The one or more vapor removal channels are defined by the wick and the liquid-distribution structure, and are in fluid communication with at least some of the vapor passages. A thermal conductance of the liquid-distribution structure is higher than a thermal conductance of the wick.

Implementations can include one or more of the following features. For example, pores of the liquid-distribution structure can be sized to provide pumping of the liquid from the wick. The pores of the liquid-distribution structure can have a size that is smaller than a size of the pores of the wick.

In another general aspect, an evaporator includes a liquid barrier wall, a liquid inlet port through the liquid barrier wall, a liquid-distribution structure, a wick, and one or more vapor removal channels. The liquid-distribution structure includes a vapor barrier wall having an outer heat-receiving surface, and microchannels along an inner surface of the vapor barrier wall. The wick is positioned between the liquid barrier wall and the liquid-distribution structure and is coupled to the liquid inlet port. The one or more vapor removal channels are defined at an interface between the wick and the liquid-distribution structure, and are in fluid communication with at least some of the liquid-distribution structure microchannels. A thermal conductance of the liquid-distribution structure is higher than a thermal conductance of the wick.

Implementations can include one or more of the following features. For example, the wick and the liquid-distribution structure can contact each other at a region that is smaller than a surface area of the wick that faces the liquid-distribution structure. The microchannels adjacent the vapor barrier wall can flow across the contact regions.

In another general aspect, a method for removing heat from a heat-producing device includes coupling an outer surface of a vapor barrier wall of a liquid-distribution structure to a heat-producing device. The method includes feeding a liquid from a wick positioned within a sealed space defined within an outer fluid enclosure that includes the liquid-distribution structure into the liquid-distribution structure through a contact area defined between the liquid-distribution structure and the wick. The method includes pumping the liquid through the liquid-distribution structure and across the vapor barrier wall using the liquid-distribution structure, and evaporating the liquid from the surface of the liquid-distribution structure to form vapor at an evaporation interface between the wick and the liquid-distribution structure. The method also includes transporting the vapor through a vapor removal channel near the outer surface of the vapor barrier wall and defined between the liquid-distribution structure and the wick and being in direct fluid communication with the evaporation interface.

Implementations can include one or more of the following features. For example, the contact area between the liquid-distribution structure and the wick can be smaller than a surface area of the wick that faces the liquid-distribution structure.

The method can include preventing heat from flowing directly from the vapor barrier wall and around the liquid-distribution structure to the wick.

In another general aspect, an evaporator includes an outer fluid enclosure, a liquid inlet port extending through the outer fluid enclosure, a liquid-distribution structure coupled to the outer fluid enclosure to define a fluidly sealed hermetic chamber, a wick positioned inside the fluidly sealed hermetic chamber and being coupled to the liquid inlet port, and a vapor removal channel defined by, and being in fluid communication with, the wick and the liquid-distribution structure. The liquid-distribution structure includes a vapor barrier wall having an outer heat-receiving surface, and the liquid-distribution structure is configured to distribute liquid over the vapor barrier wall. The vapor removal channel is in direct fluid communication with an evaporation interface defined between the liquid-distribution structure and the wick.

In another general aspect, an evaporator includes a liquid barrier wall, a liquid inlet port extending through the liquid barrier wall, a vapor barrier wall extending along a vapor barrier plane, a wick positioned between the liquid barrier wall and the vapor barrier wall and coupled to the liquid inlet port, a liquid flow channel located between the liquid barrier wall and the wick and coupled to the liquid inlet port, a first vapor removal channel that is located at an interface region between the wick and the vapor barrier wall and that extends along the vapor barrier plane in a first direction, and a second vapor removal channel that is located at the interface region between the wick and the vapor barrier wall. The second vapor removal channel extends along the vapor barrier plane and is non-parallel to the first vapor removal channel.

Implementations can include one or more of the following features. For example, the second vapor removal channel can be transverse to the first vapor removal channel.

In another general aspect, a heat transfer system includes an evaporator, a condenser including a vapor inlet and a liquid outlet, a vapor line, and a liquid line. The evaporator includes an outer fluid enclosure, a liquid inlet port coupled through the outer fluid enclosure, and a liquid-distribution structure coupled to the outer fluid enclosure to define a fluidly sealed hermetic chamber. The liquid-distribution structure includes a vapor barrier wall having an outer heat-receiving surface and an inner surface and being configured to distribute liquid over the inner surface of the vapor barrier wall. The evaporator also includes a wick positioned inside the fluidly sealed hermetic chamber and being coupled to the liquid inlet port, and a vapor removal channel defined by and being in fluid communication with the wick and the liquid-distribution structure. The vapor removal channel is in direct fluid communication with an evaporation interface defined between the liquid-distribution structure and the vapor barrier wall. The vapor line provides fluid communication between the vapor removal channel of the evaporator and the vapor inlet of the condenser. The liquid line provides fluid communication between the liquid inlet port of the evaporator and the liquid outlet of the condenser.

Implementations can include one or more of the following features. The heat transfer system can include a reservoir in fluid communication with the liquid line.

The evaporator can include a fluid outlet port coupled through the outer fluid enclosure, and the heat transfer system can include a secondary system coupled to the evaporator at least through a sweepage line that couples to the fluid outlet port. The outlet port can be in fluid communication with the wick. The secondary system can include a secondary evaporator and a reservoir.

Other features and advantages will be apparent from the description, the drawings, and the claims.

DESCRIPTION OF DRAWINGS

Like reference symbols in the various drawings indicate like elements.

DETAILED DESCRIPTION

Figure 1A:
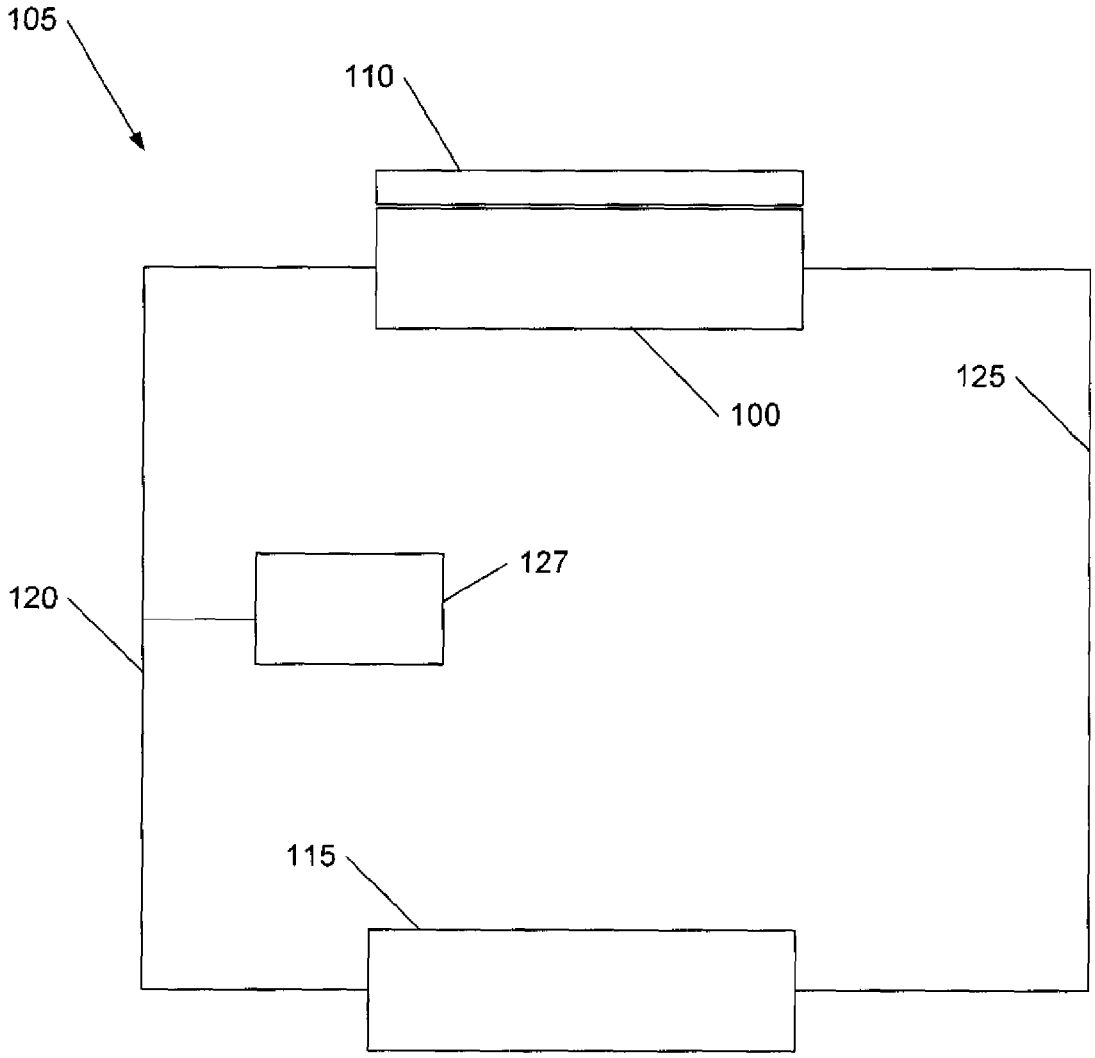
FIGS. 1A and 1B are block diagrams of two heat transfer systems.

Referring to FIG. 1A, an evaporator 100 is the heat acquisition component in a two-phase loop heat transfer system 105 that transports heat from one location (a heat source 110) to another location (a heat sink). As described below, the evaporator 100 is designed with a high thermal conductance (for example, about 10 W/cm$^2$-K) and is able to work in high heat flux applications, that is, in applications having a heat flux of about 100 W/cm$^2$ (645 W/in$^2$). The evaporator 100 includes internal parts that are designed and placed to facilitate local thermal and mechanical needs within the evaporator 100 to enable operation in such high heat flux applications.

The heat transfer system 105 also includes a condenser 115 coupled to the evaporator 100 by a liquid line 120 and a vapor line 125. In use, the evaporator 100 is thermally coupled to the heat source 110, the condenser 115 is thermally coupled to a heat sink, and fluid flows between the evaporator 100 and the condenser 115. The fluid within the heat transfer system 105 can be referred to as the working fluid. As used in this description, the term "fluid" is a generic term that refers to a liquid, a vapor, or a mixture of a liquid and a vapor. The heat transfer system 105 also includes a fluid reservoir 127 coupled to the liquid line 120. The fluid reservoir 127 accommodates redistribution or volume changes of the fluid within the system 105 and facilitates temperature control within the system 105. In other implementations, the fluid reservoir 127 can be coupled directly to the evaporator 100.

Figure 1B:
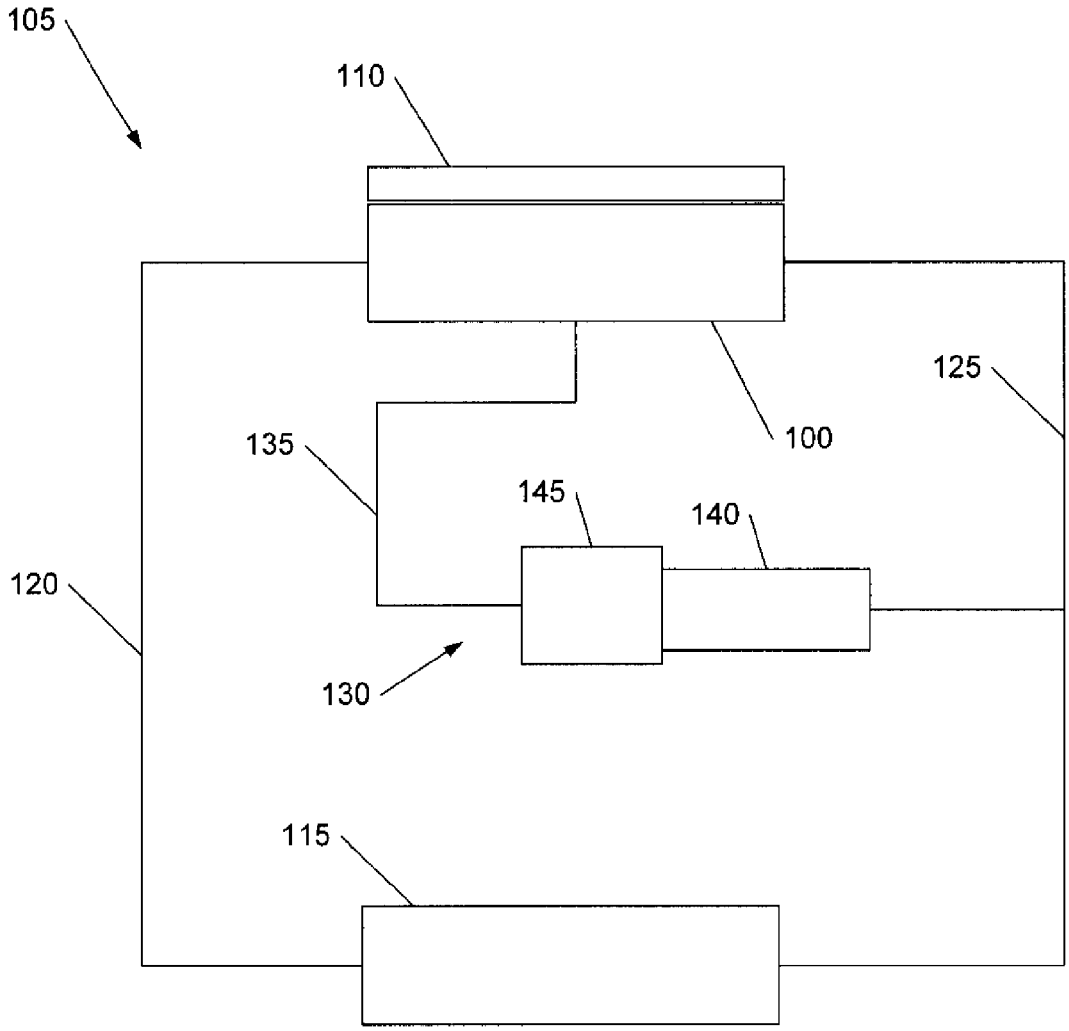

Referring to FIG. 1B, in another implementation, the heat transfer system 105 also includes a secondary system 130 coupled to the evaporator 100 through a sweepage line 135. The secondary system 130 includes a secondary evaporator 140 and a reservoir 145 thermally and hydraulically coupled to the secondary evaporator 140. The secondary system 130 ensures that liquid is present in a wick of the evaporator 100 at start up and provides excess liquid flow to the evaporator 100 such that any vapor bubbles that form on the liquid side of the evaporator 100 are removed from the evaporator 100. The heat transfer system 105 can also include additional evaporators in parallel or series with the evaporator 100.

Figure 2:
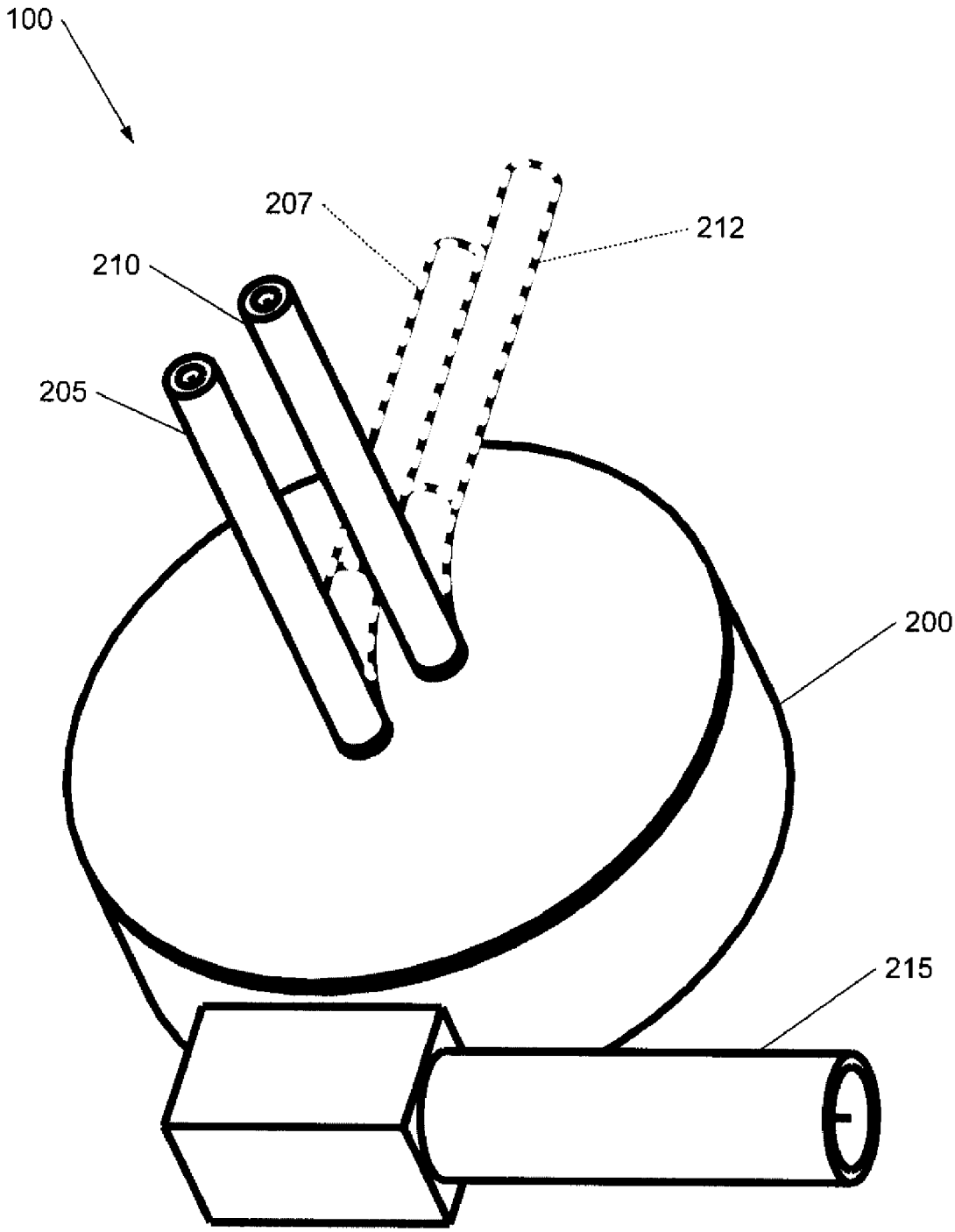
FIG. 2 is a perspective view of an evaporator that can be used in the heat transfer systems of FIGS. 1A and 1B.
Figure 3:
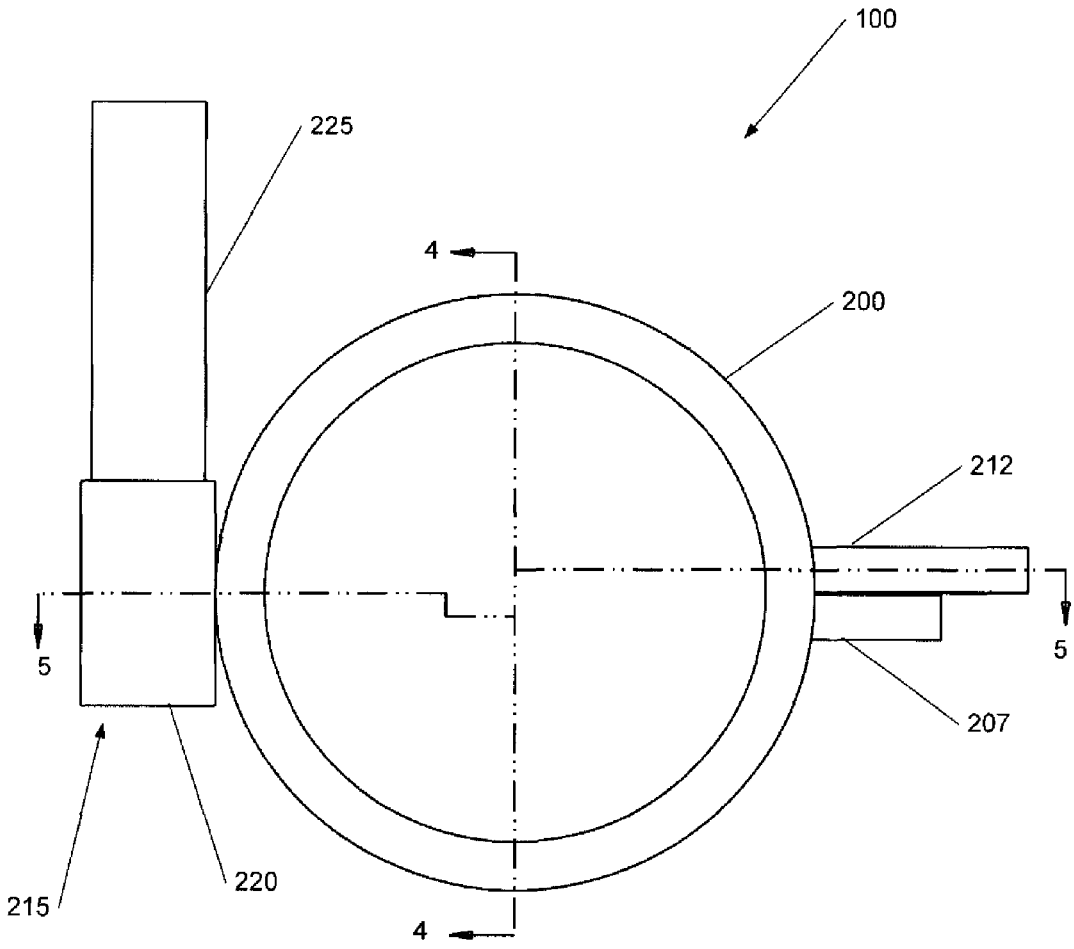
FIG. 3 is a bottom plan view of the evaporator of FIG. 2.

Referring to FIGS. 2 and 3, the evaporator 100 includes an outer fluid enclosure 200, a liquid inlet port 205 extending through the outer enclosure 200, a fluid outlet port 210 extending from the outer enclosure 200, and a vapor outlet port 215 extending from the outer enclosure 200. In FIG. 2, the liquid inlet port 205 and the fluid outlet port 210 are shown as straight tubes extending out of the outer enclosure 200. As an alternative to the straight tube design, a liquid inlet port 207 and a fluid outlet port 212 may be bent in a low profile design to extend along the surface of the outer enclosure 200, as is also shown in FIGS. 2 and 3. Additionally, the vapor outlet port 215 includes a vapor port fitting 220 coupled to the outer enclosure 200 and a vapor port tube 225 extending from the vapor port fitting 220. The liquid inlet port 205 couples to the liquid line 120 from the condenser 115. If the system 105 includes the secondary system 130, then the fluid outlet port 210 couples to the sweepage line 135.

Figure 4:
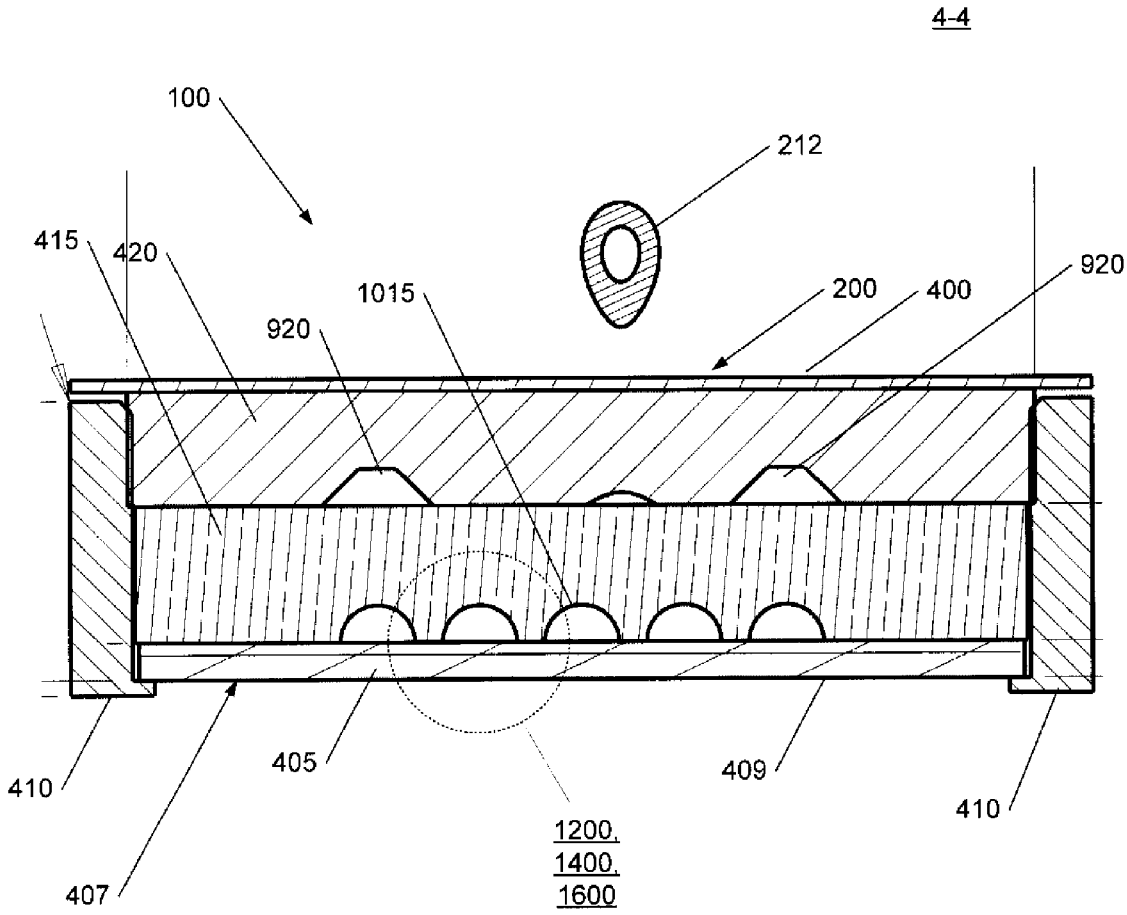
FIG. 4 is a cross-sectional view of the evaporator of FIG. 3 taken along section line 4-4.
Figure 5:
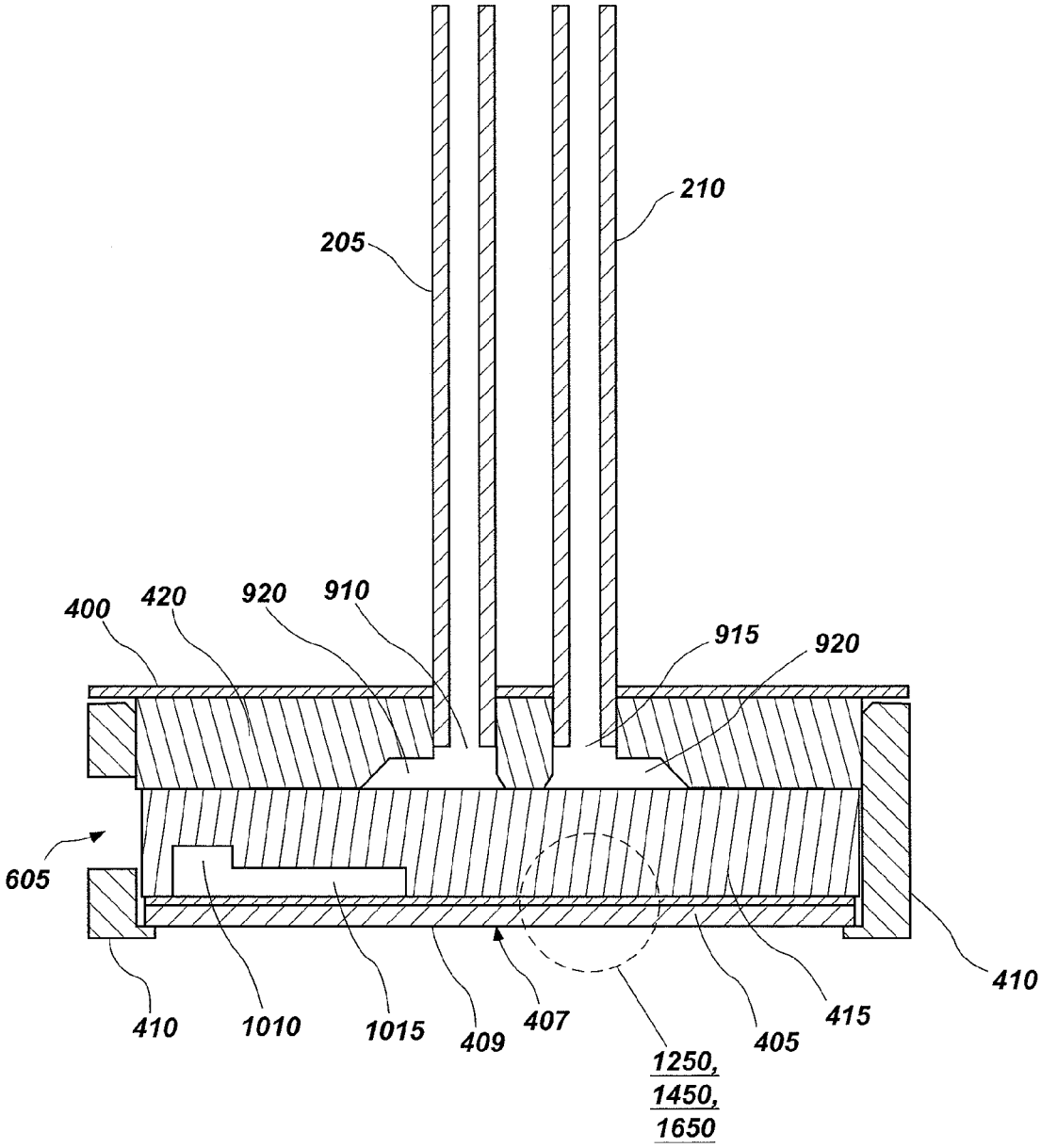
FIG. 5 is a cross-sectional view of the evaporator of FIG. 3 taken along section line 5-5.
Figure 6A:
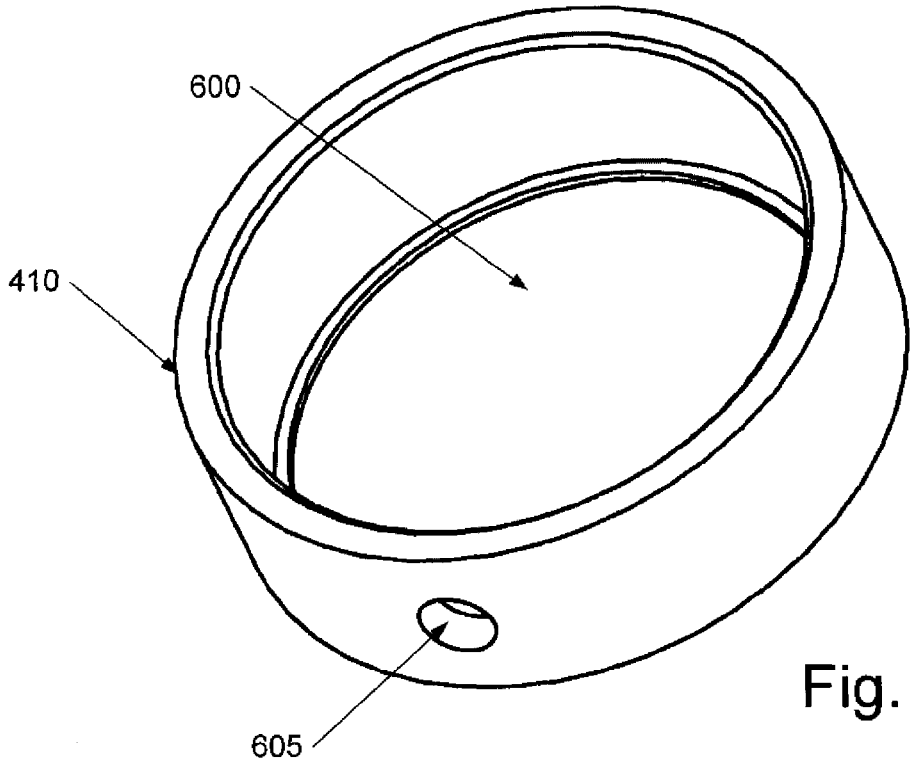
FIG. 6A is a perspective view of a side wall of the evaporator of FIG. 2.
Figure 6B:
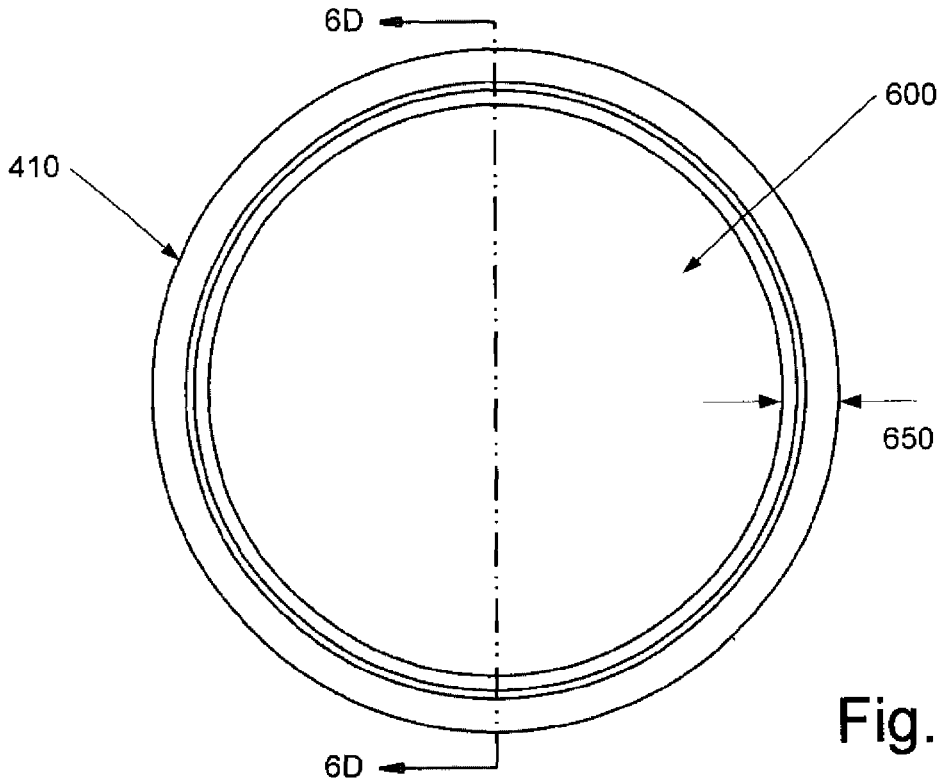
FIG. 6B is a top plan view of the side wall of FIG. 6A.
Figure 6C:
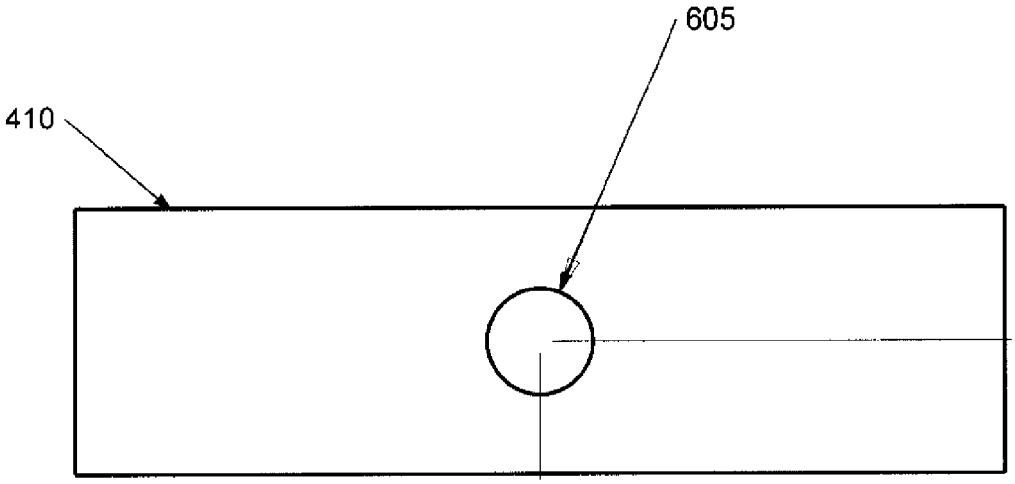
FIG. 6C is a side plan view of the side wall of FIG. 6A.
Figure 6D:
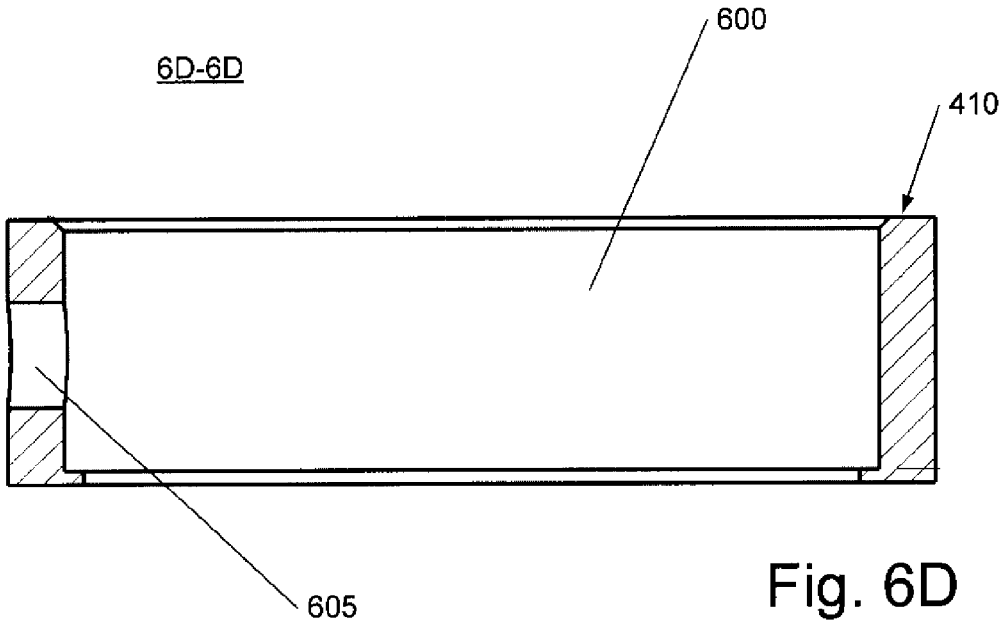
FIG. 6D is a cross-sectional view of the side wall of FIG. 6B taken along section line 6D-6D.
Figure 7A:
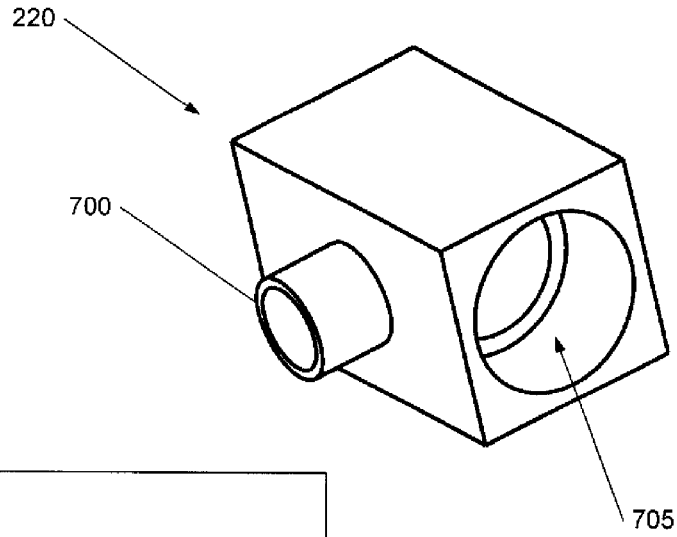
FIG. 7A is a perspective view of a vapor port fitting of the evaporator of FIG. 2.
Figure 7B:
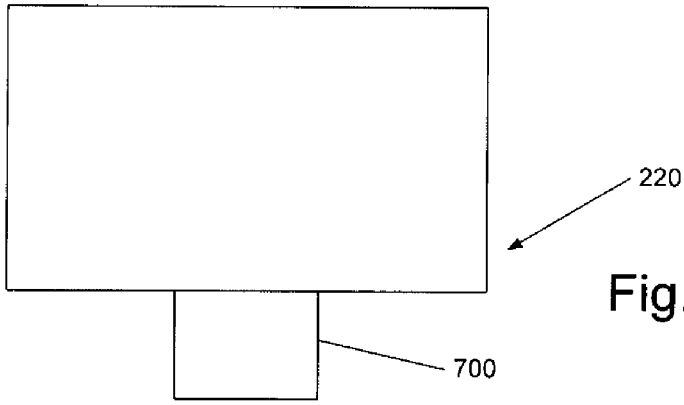
FIGS. 7B through 7D are plan views of the vapor port fitting of FIG. 7A.
Figure 7C:
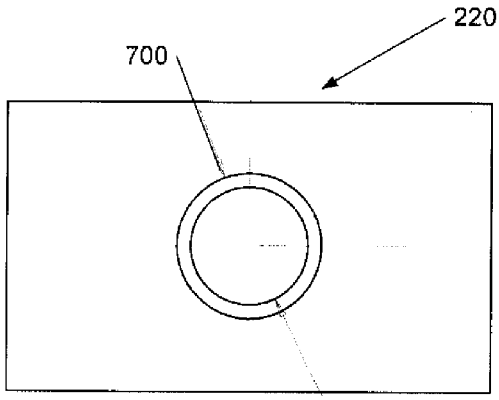
Figure 7D:
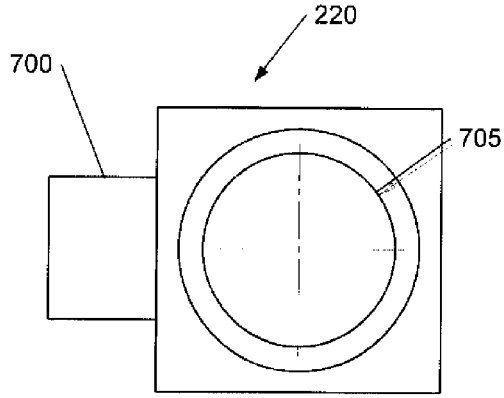

Referring also to FIGS. 4 and 5, the outer enclosure 200 includes a liquid barrier wall 400, a liquid-distribution structure 407 that includes a vapor barrier wall 405 having a heat-receiving surface 409 that mates with the heat source 110, and a side wall 410 that is sealed on respective ends to the liquid-distribution structure 407 to form or define a fluidly sealed hermetic chamber for working fluid within the outer enclosure 200. The evaporator 100 includes a wick 415 positioned between an inner side of the liquid barrier wall 400 and an inner side of the liquid-distribution structure 407. The evaporator 100 can also include a sealing device 420 positioned between the wick 415 and the inner side of the liquid barrier wall 400.

The liquid-distribution structure 407 has a low thermal impedance and, therefore, a high thermal conductance. The thermal conductance of the liquid-distribution structure 407 is proportional to the thermal conductivity and inversely proportional to the thickness of the liquid-distribution structure 407. In particular, the liquid-distribution structure 407 (including the vapor barrier wall 405) has a thermal impedance that is lower than a thermal impedance of the wick 415. In this way, heat from the heat source 110 is able to freely pass through the vapor barrier wall 405 and through the liquid-distribution structure 407, but heat is not as free to pass through the wick 415. Thus, the heat is localized at an interface between the liquid-distribution structure 407 and the wick 415. Additionally, the liquid-distribution structure 407 distributes liquid by pumping the liquid through the wick 415 to and along the surface of the vapor barrier wall 405 for better heat distribution, as further discussed below.

Referring to FIGS. 6A through 6D, the side wall 410 has a generally cylindrical shape that includes a central opening 600 large enough to accommodate the wick 415 and the sealing device 420, and a side opening 605 that couples with the vapor outlet port 215. The thickness 650 of the side wall 410 is selected based on the material, the need to attach other devices (such as the vapor outlet port 215, the liquid barrier wall 400, and the liquid-distribution structure 407) to the side wall 410, and the need to reduce or minimize conduction of heat through the side wall 410 from the liquid-distribution structure 407 to the liquid barrier wall 400 and to the wick 415. Moreover, the side wall 410 is made of a low conductivity material to further minimize or reduce conduction of heat through the side wall 410 from the liquid-distribution structure 407 to the liquid barrier wall 400 and to the wick 415. In one implementation, the side wall 410 is made of MONEL® 400.

Referring to FIGS. 7A through 7D, the vapor port fitting 220 includes a vapor extension tube 700 that is sized to fit into the side opening 605 of the side wall 410 and a vapor port opening 705 large enough to accommodate the vapor port tube 225. The vapor port fitting 220 can be made of any suitable material such as, for example, copper or MONEL®, as long as the fitting 220 can be properly sealed to the side wall 410. For example, the vapor port fitting 220 can be sealed to the side wall 410 by, for example, soldering, brazing, or welding.

Figure 8A:
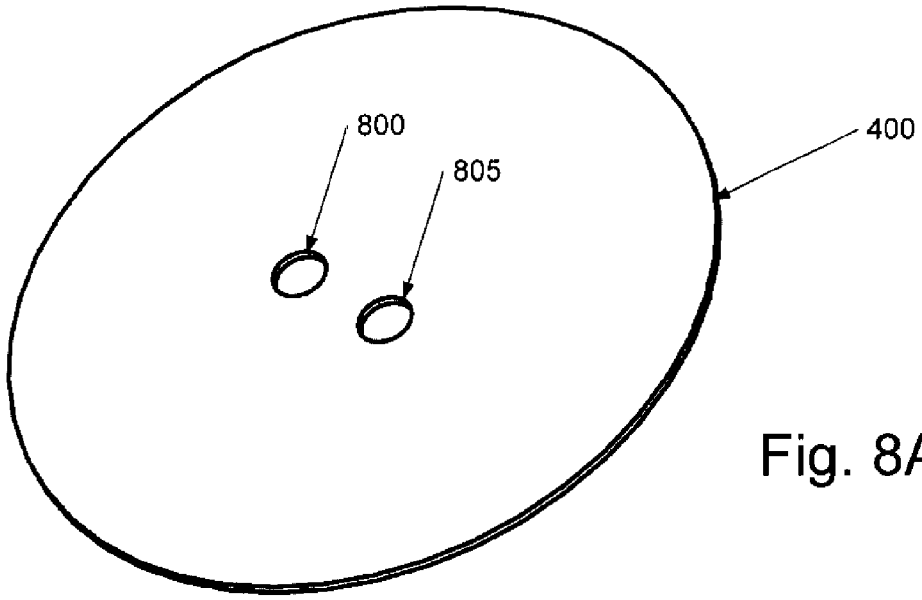
FIG. 8A is a perspective view of a liquid barrier wall of the evaporator of FIG. 2.
Figure 8B:
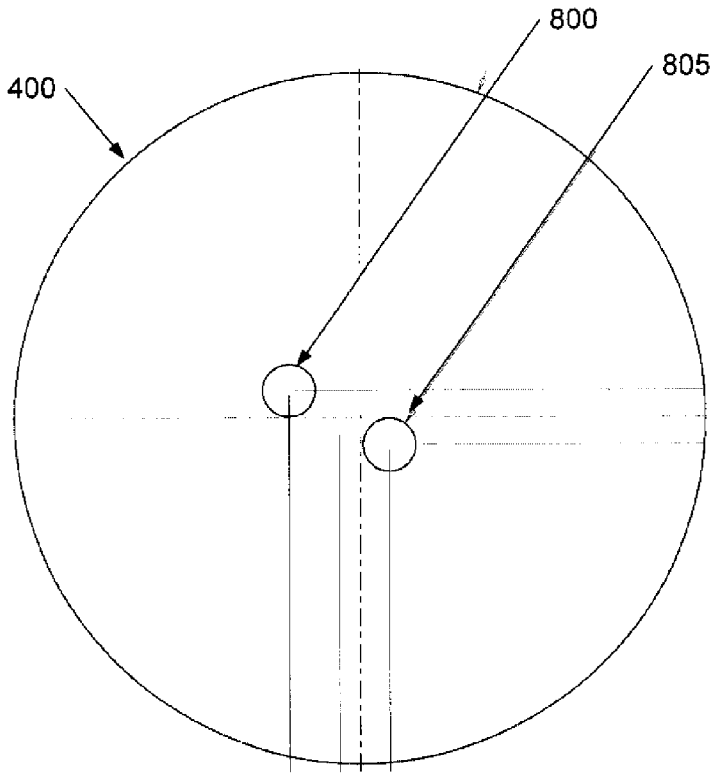
FIGS. 8B and 8C are plan views of the liquid barrier wall of FIG. 8A.
Figure 8C:
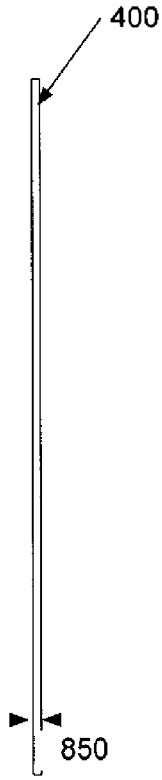
Figure 9A:
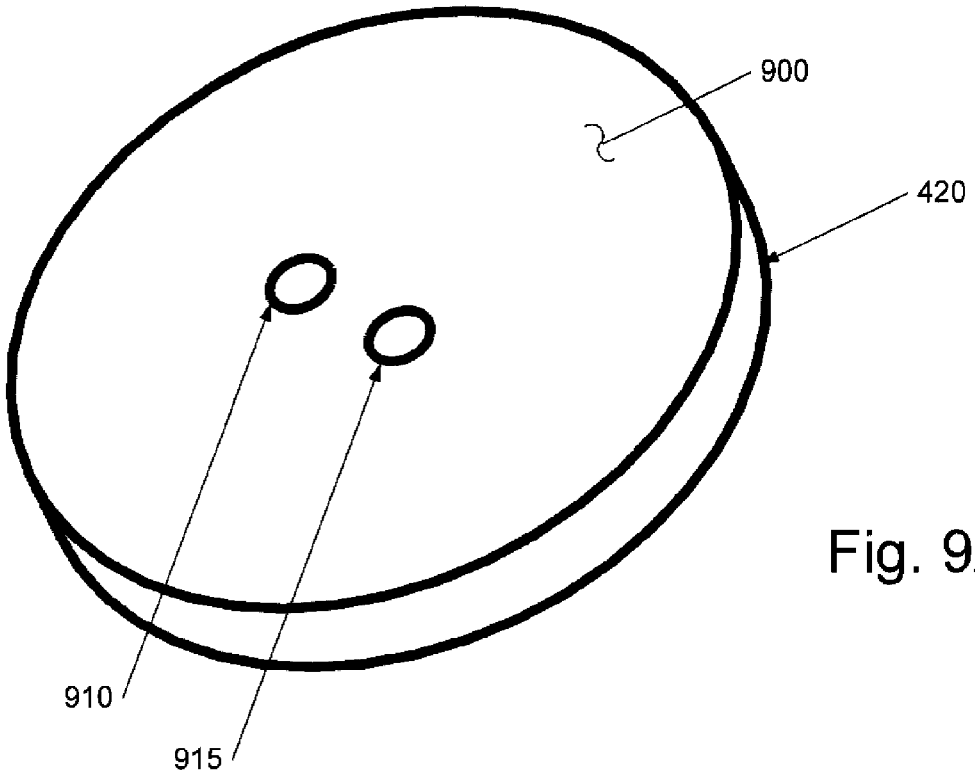
FIG. 9A is a perspective view of a sealing device of the evaporator of FIG. 2.
Figure 9B:
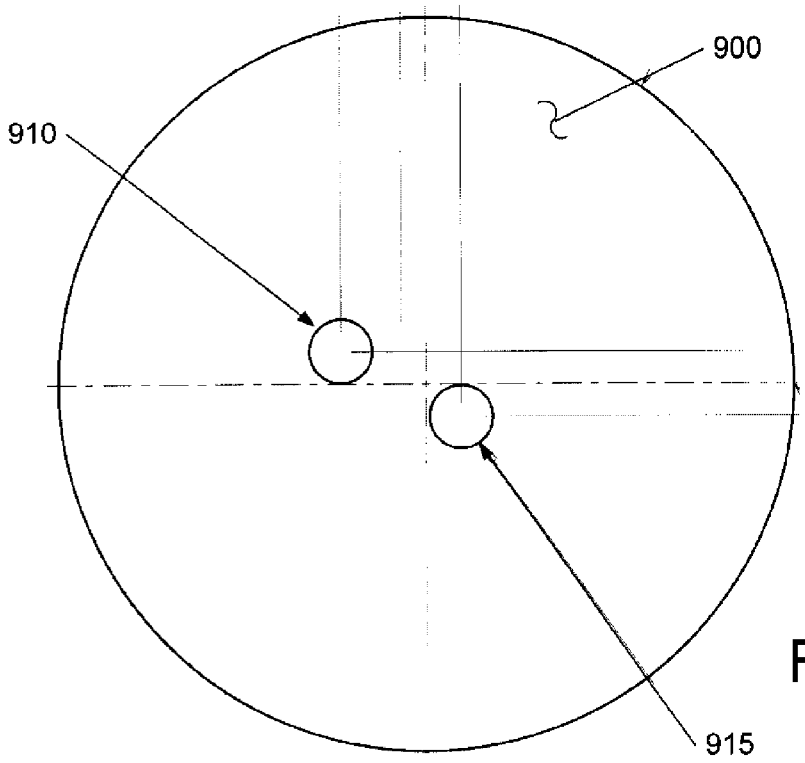
FIGS. 9B and 9C are plan views of the sealing device of FIG. 9A.
Figure 9C:
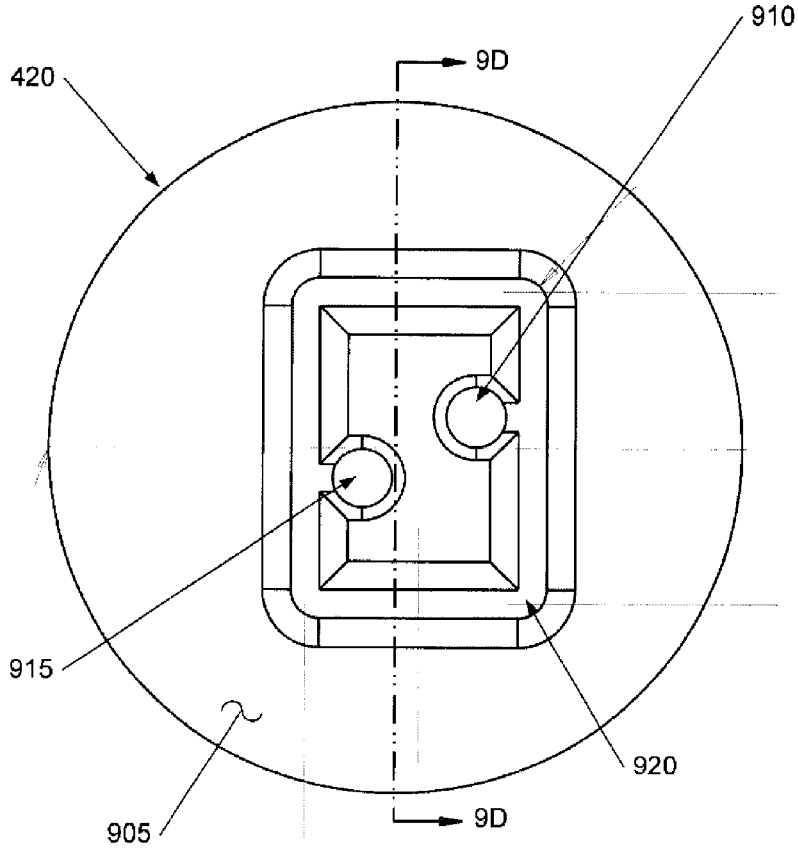
Figure 9D:
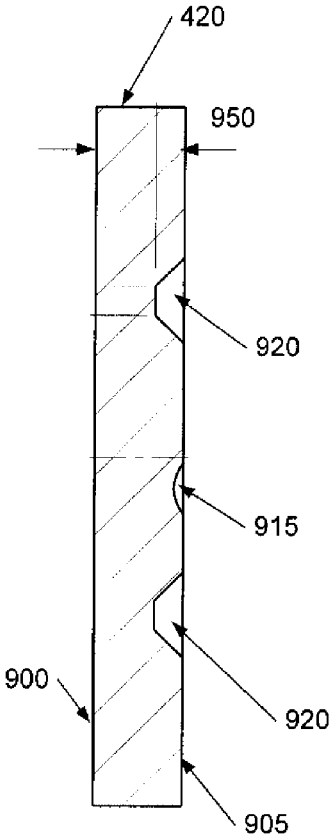
FIG. 9D is a side cross-sectional view of the sealing device of FIG. 9A.
Figure 10A:
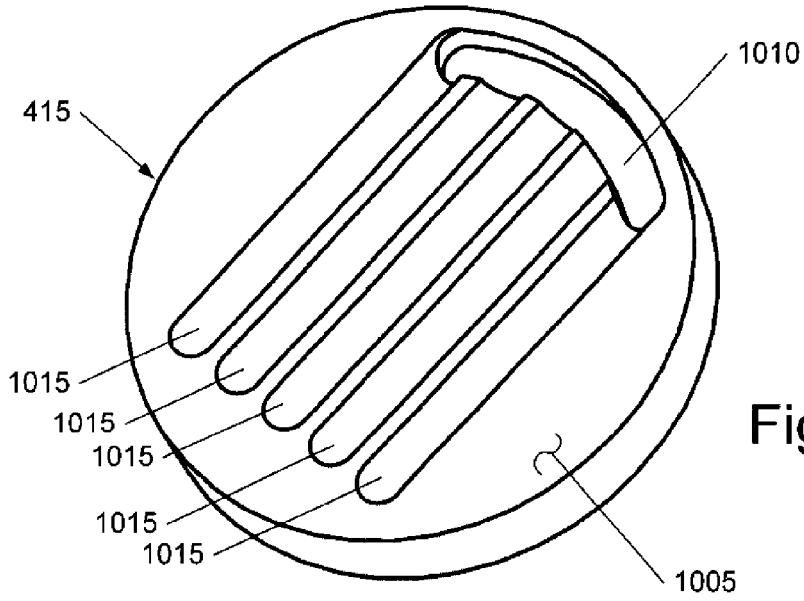
FIG. 10A is a perspective view of a wick of the evaporator of FIG. 2.
Figure 10B:
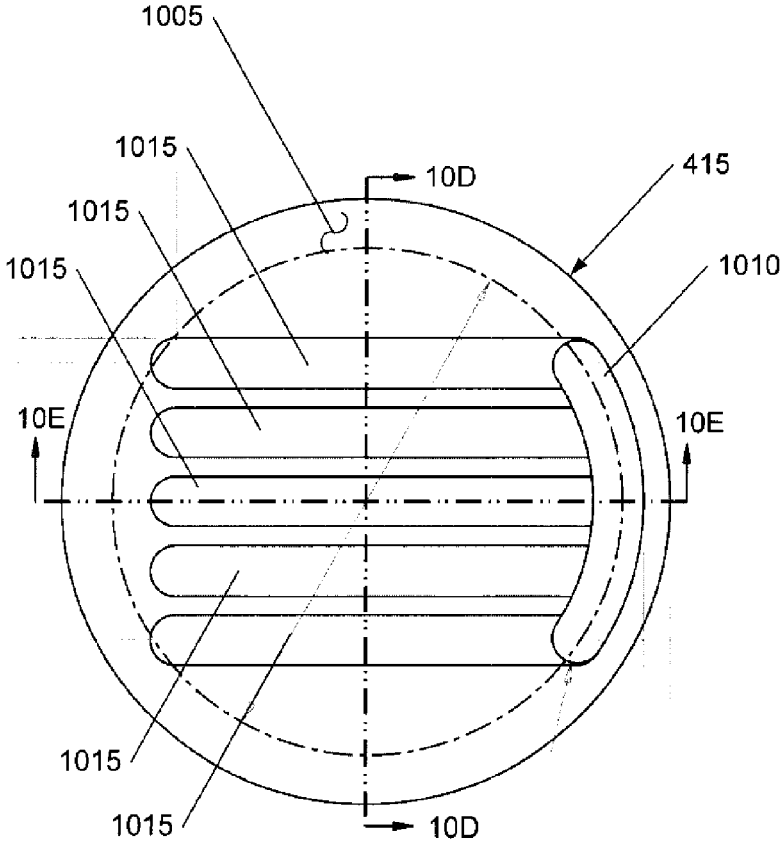
FIGS. 10B and 10C are top and side plan views of the wick of FIG. 10A.
Figure 10C:
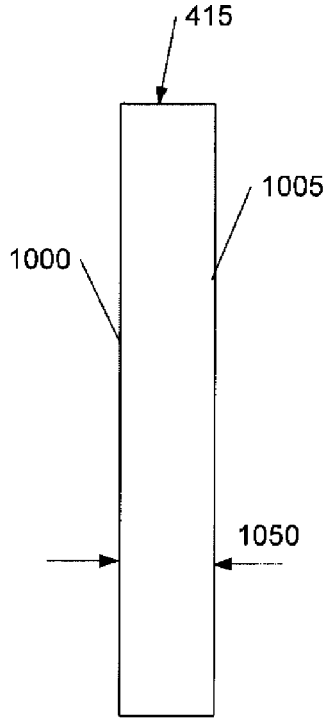
Figure 10D:
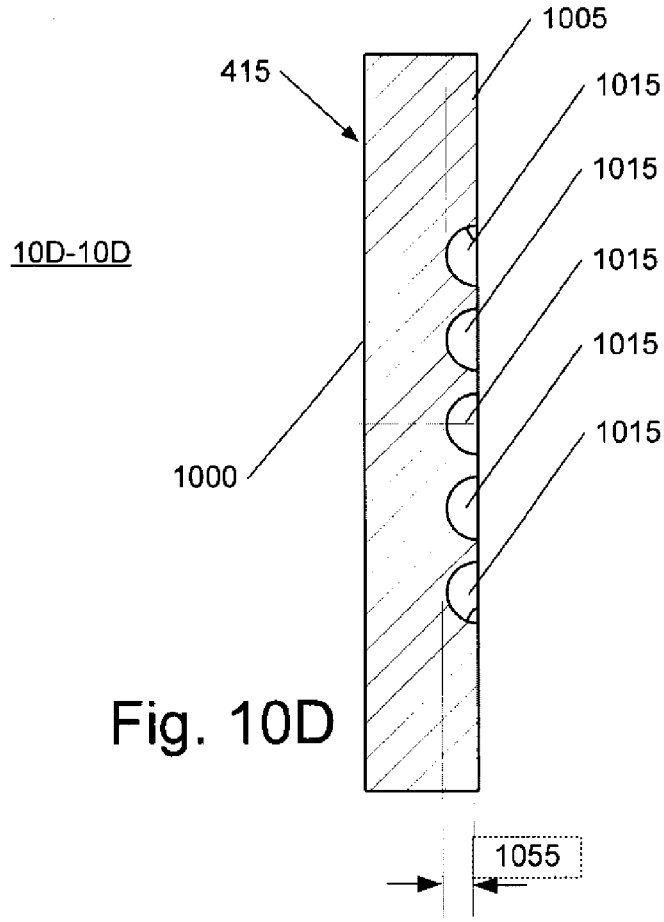
FIG. 10D is a cross-sectional view of the wick of FIG. 10B taken along section line 10D-10D.
Figure 10E:
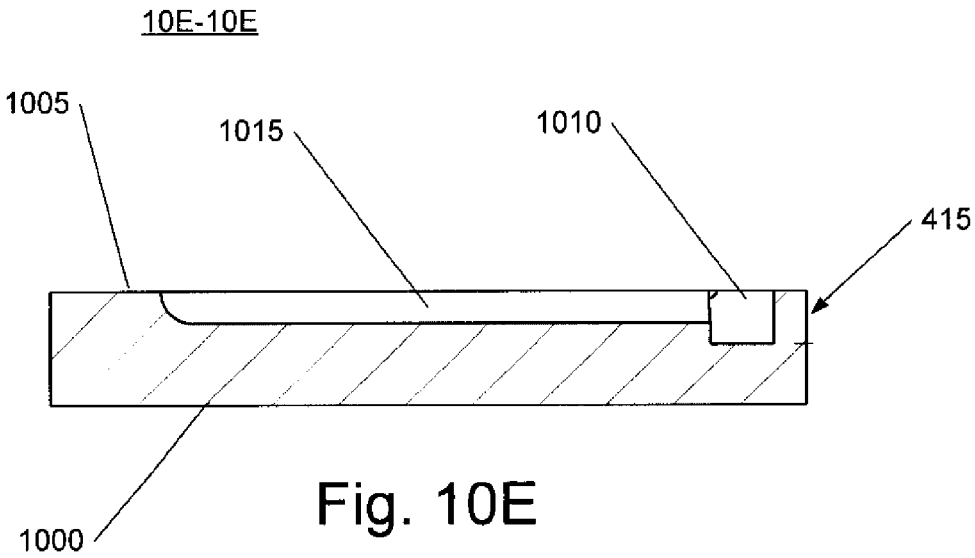
FIG. 10E is a cross-sectional view of the wick of FIG. 10B taken along section line 10E-10E.
Figure 11A:
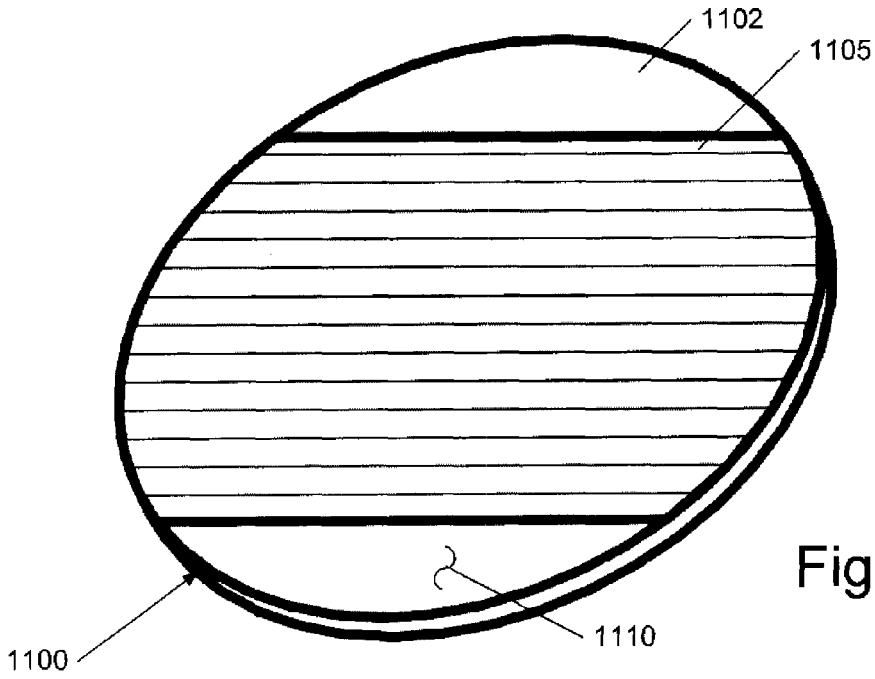
FIG. 11A is a perspective view of a liquid-distribution structure of the evaporator of FIG. 2.
Figure 11B:
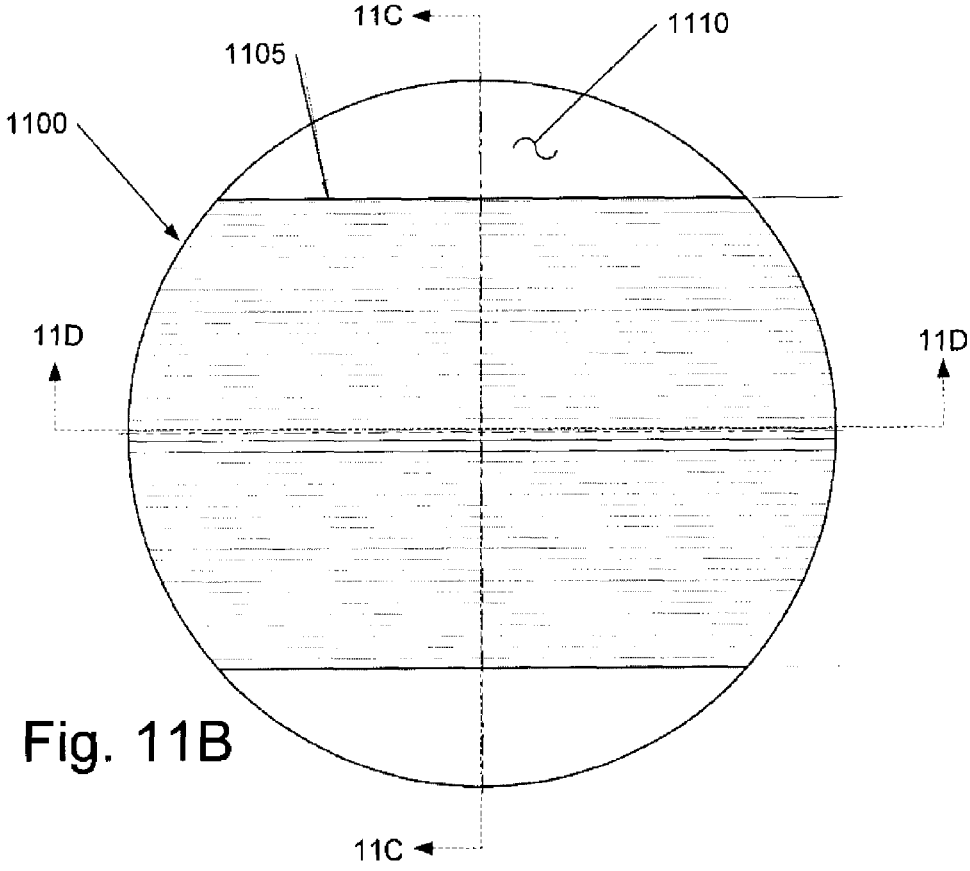
FIG. 11B is a top plan view of the liquid-distribution structure of FIG. 11A.
Figure 11E:
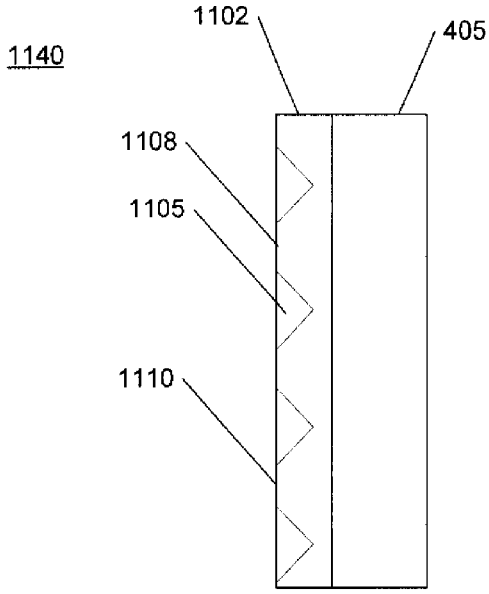
FIG. 11E is an enlarged cross-sectional view of the liquid-distribution structure of FIG. 11C.
Figure 11C:
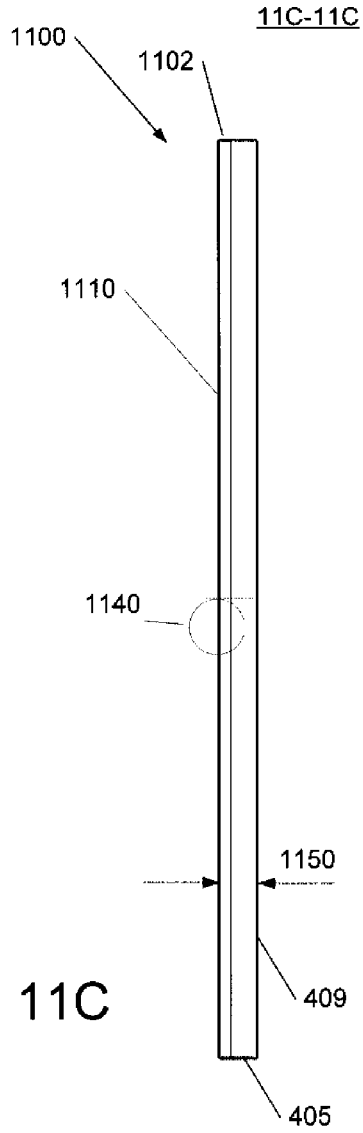
FIGS. 11C and 11D are cross-sectional views of the liquid-distribution structure of FIG. 11A taken along section lines 11C-11C and 11D-11D, respectively, of FIG. 11B.
Figure 11D:
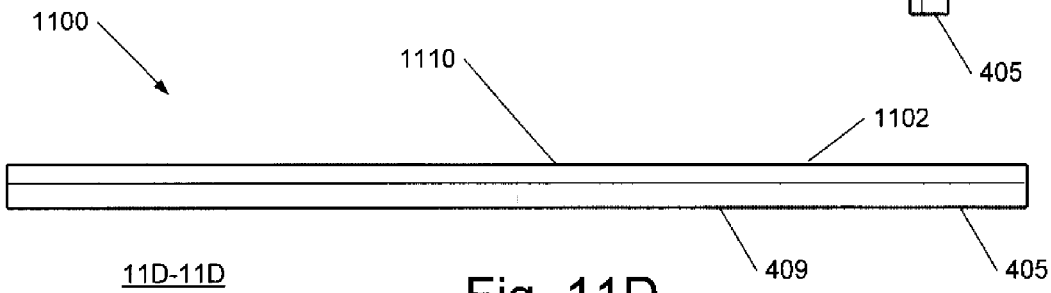

Referring to FIGS. 8A through 8C, the liquid barrier wall 400 has a generally flat, thin, disk shape with a thickness 850. The liquid barrier wall 400 includes an opening 800 for receiving the liquid inlet port 205 or 207 (FIG. 2) and an opening 805 for receiving the fluid outlet port 210 or 212 (FIG. 2). The liquid barrier wall 400 can be made of any material suitable for reducing or minimizing heat conduction such as, for example, MONEL®, stainless steel, ceramic, or plastic.

Referring to FIGS. 9A through 9D, the sealing device 420 is formed as a disk that has a size that matches the liquid barrier wall 400 and the wick 415. The sealing device 420 has a first flat surface 900 that contacts the liquid barrier wall 400 when the evaporator 100 is assembled, a second surface 905 that contacts the wick 415 when the evaporator 100 is assembled, and a thickness 950 as measured from the first surface 900 to the second surface 905. Additionally, the sealing device 420 includes a first opening 910 in fluid communication with the liquid inlet port 205 or 207 (FIG. 2) and a second opening 915 in fluid communication with the fluid outlet port 210 or 212 (FIG. 2). The second surface 905 includes a fluid channel 920 in fluid communication with the first and second openings 910, 915, respectively. As shown in this implementation, the fluid channel 920 has a cross-sectional shape that is trapezoidal to facilitate sweepage of non-condensable gas bubbles from the evaporator 100. In particular, liquid entering the evaporator 100 from the liquid line 120 that includes non-condensable gas bubbles tends to cling (due to surface tension) to the acute corners formed between the wick 415 and the sealing device 420 within the fluid channel 920. In this way, the non-condensable gas bubbles within the entering liquid remain separated from the liquid and flow with the liquid through the fluid channel 920.

The sealing device 420 can be non-porous or porous. If porous, the sealing device 420 has pores that have a size that is large enough to saturate with liquid but that is small enough to block vapor. The size of the pores of the sealing device 420 is generally smaller than the size of the pores of the wick 415, for example, the pore size of the sealing device 420 can be half the pore size of the wick 415. The sealing device 420 functions as a gasket that seals to the liquid barrier wall 400 and the wick 415 when the evaporator 100 is assembled. Thus, the sealing device 420 is made of a material that is non-reactive and is formable or pliable. In one implementation, the sealing device 420 is made of polytetrafluoroethylene (PTFE). In other implementations, the sealing device 420 can be made of other suitable polymers such as fluorinated ethylene-propylene (FEP) and perfluoroalkoxy polymer resin (PFA), glass, fiber, or ceramic materials.

Referring to FIGS. 10A through 10E, the wick 415 has a first surface 1000 and a second surface 1005 and a thickness 1050 as defined between the first and second surfaces 1000, 1005. The first surface 1000 is generally flat and contacts the sealing device 420 when the evaporator 100 is assembled. The second surface 1005 is generally flat and contacts the vapor barrier wall 405 when the evaporator 100 is assembled. The second surface 1005 includes a vapor header channel 1010 that is in fluid communication with the side opening 605 of the side wall 410, and one or more vapor flow channels (e.g., a vapor removal channel 1015) in fluid communication with the vapor header channel 1010 and having a depth 1055. The wick 415 is made of a material having a low thermal conductivity to reduce heat conduction from the sealing device 420 to the liquid-distribution structure 407 and having a pore size sufficient for fluid flow across the wick 415. For example, in one implementation, the wick 415 is made of a non-metallic material such as polyetheretherketone (PEEK™), a thermoplastic resin manufactured by Victrex plc., West Conshohocken, Pa. PEEK™ also has low friction, dimensional stability, low outgassing, and exhibits good machinability. In one implementation, a thermal conductivity of PEEK™ is about 0.23 W/m-K. In other examples, the wick 415 can be made of PTFE, polyethylene, ceramic, glass, other types of plastic, or any suitable combination of two or more of PEEK™, PTFE, polyethylene, ceramic, glass, or other types of plastic.

In one implementation, the evaporator 100 has the shape of a disk having an outer diameter of about 2.54 cm (1.0 inch) and a thickness of about 5 mm to 10 mm. In this implementation, the side wall 410 has a thickness 650 of about 0.140 inch, the liquid barrier wall 400 has a thickness 850 of about 0.2 inch, the sealing device 420 has a thickness 950 of about 0.185 inch, and the wick 415 has a thickness 1050 of about 0.22 inch and the vapor removal channels 1015 have a depth of about 0.06 inch. If the sealing device 420 is porous, then the pore size of the sealing device 420 can be about 1 μm to 10 μm if using water as a working fluid.

As discussed above, the evaporator 100 includes the liquid-distribution structure 407 that lets heat freely pass from the heat source 110 and that distributes liquid by pumping the liquid from the wick 415 to and along the surface of the vapor barrier wall 405 for better heat distribution. To this end, the vapor barrier wall 405 and the liquid-distribution structure 407 can be designed with these considerations in mind. In this implementation, the wick 415 acts to supply liquid to the vapor barrier wall 405 and maintains a pressure differential. Pumping occurs at a location where evaporation takes place, which is the region between the liquid-distribution structure 407 and the wick 415.

Referring again to FIGS. 4 and 5, the wick 415 is positioned between the liquid barrier wall 400 and the liquid-distribution structure 407, and the wick 415 is fluidly coupled to the liquid inlet port 205, which extends through the liquid barrier wall 400 and feeds fluid to the wick 415. The fluid channel 920 is defined between the wick 415 and the liquid barrier wall 400. Moreover, if the sealing device 420 is incorporated in the evaporator 100, then the fluid channel 920 is defined between the wick 415 and the sealing device 420. The vapor removal channel 1015 is defined by and is in fluid communication with the wick 415 and the liquid-distribution structure 407, and is remote from the liquid inlet port 205 and the fluid channel 920. The vapor removal channel 1015 is near the heat-receiving surface 409 of the vapor barrier wall 405. That is, the relative size of the liquid-distribution structure 407 and the wick 415 is such that the liquid-distribution structure 407 has a height that is smaller than a height of the wick 415 such that the vapor removal channel 1015 is near the heat-receiving surface 409. The thermal conductivity of the liquid-distribution structure 407 is higher than a thermal conductivity of the wick 415.

Referring to FIGS. 11A through 11E, in a first implementation, the liquid-distribution structure 407 can be designed as a thin film device 1100 including the vapor barrier wall 405 and a porous device 1102 attached or integrated with the vapor barrier wall 405. The porous device 1102 includes vapor passages 1105 formed along an inner surface 1110 of the thin film device 1100 between pyramidal projections 1108. The thin film device 1100 includes pores that have a size that is large enough to distribute liquid and are in fluid communication with the vapor passages 1105.

The thin film device 1100 has a thickness 1150 that is significantly smaller than a thickness of the wick 415. In this way, the vapor removal channel 1015 of the wick 415 is near the heat-receiving surface 409 of the vapor barrier wall 405. Thus, for example, if the wick 415 has a thickness 1050 of about 0.22 inch, the thin film device 1100 can have a thickness 1150 of about 0.06 inch and a pore size of about 2 um to 4 μm. Additionally, the vapor passages 1105 can have a width of about 0.00083 inch with a pitch of about 600 fins per inch. The thin film device 1100 can be made of any thermally conductive material to enable heat transfer from the heat source 110. For example, the thin film device 1100 can be made of copper having a 35% porosity.

The vapor barrier wall 405 of the thin film device 1100 has a disk shape with a diameter that is small enough to fit within the side wall 410 but is comparable to the size of the porous device 1102. The vapor barrier wall 405 is made of a thermally conductive material such as copper to facilitate heat transfer from the heat source 110 to the evaporator 100.

Figure 12A:
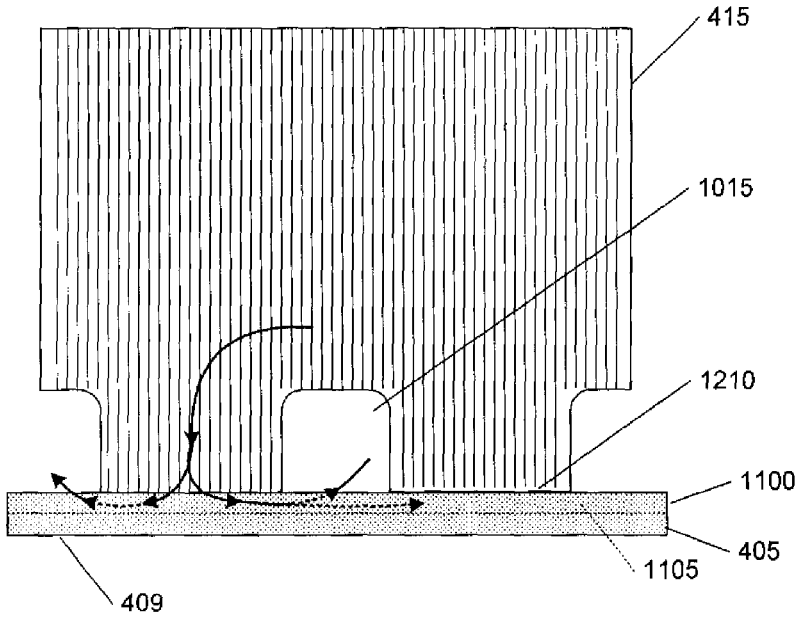
FIGS. 12A and 12B are enlarged cross-sectional views of the evaporator of FIGS. 4 and 5, respectively, with the liquid-distribution structure of FIG. 11A.
Figure 12B:
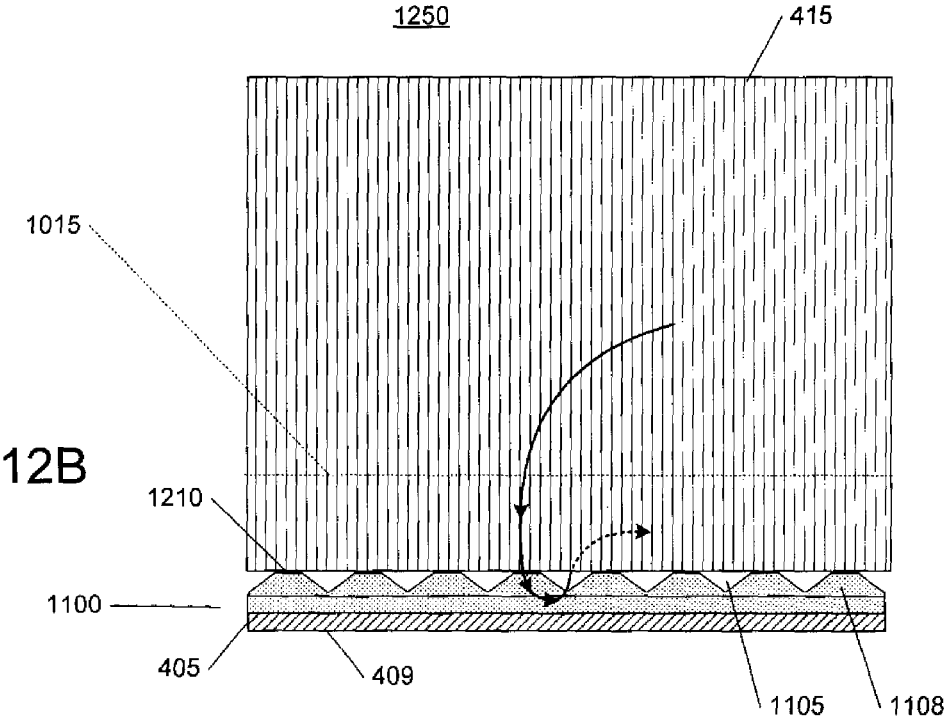

Referring to enlarged cross-sectional views 1200 and 1250 of FIGS. 12A and 12B, respectively, an interface between the thin film device 1100 and the wick 415 is shown. The vapor removal channels 1015 of the wick 415 extend generally along an axis that is non-parallel to (for example, perpendicular to) an axis along which the vapor passages 1105 extend. The vapor removal channels 1015 are in fluid communication with at least a portion of the vapor passages 1105 and the second surface 1005 of the wick 415 contacts the inner surface 1110 of the thin film device 1100 at regions 1210.

In operation, liquid is fed into the evaporator 100 through the liquid inlet port 205 and into the fluid channel 920 of the sealing device 420. Liquid flows through the wick 415 from the sealing device 420, and the liquid feeds into the thin film device 1100 across the regions 1210 where the second surface 1005 of the wick 415 contacts the inner surface 1110 of the thin film device 1100. Liquid then flows through the thin film device 1100 and toward the vapor removal channels 1015, where the liquid evaporates at the interface between the vapor removal channel 1015 and the thin film device 1100 to form a vapor. The vapor flows through the vapor removal channel 1015 to the vapor header channel 1010, out of the vapor outlet port 215, and into the vapor line 125. Moreover, vapor and/or non-condensable gas bubbles formed at the interface between the wick 415 and the sealing device 420 can be swept out of the evaporator 100 through the fluid channel 920 and the fluid outlet port 210 and into the sweepage line 135.

Figure 13A:
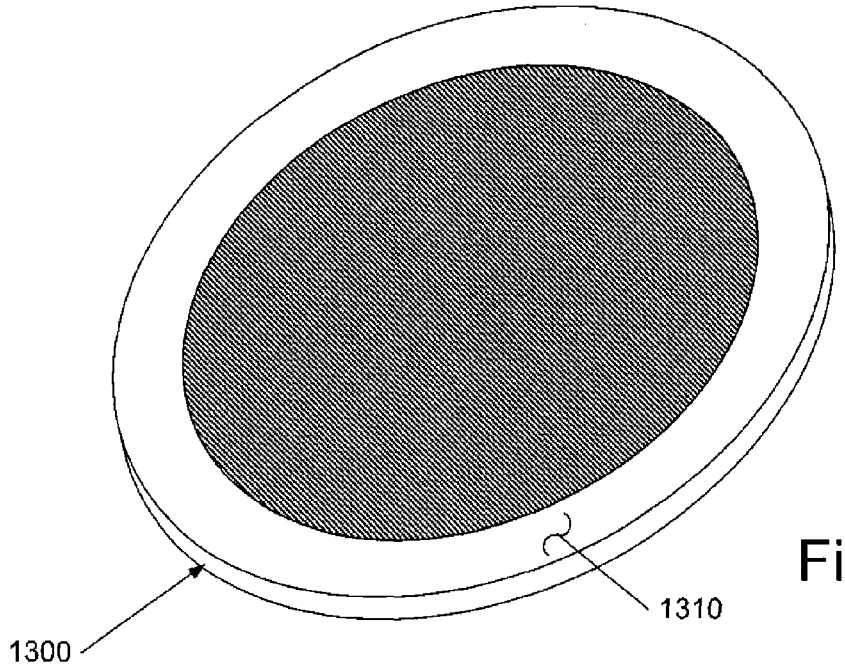
FIG. 13A is a perspective view of a second implementation of a liquid-distribution structure of the evaporator of FIG. 2.
Figure 13B:
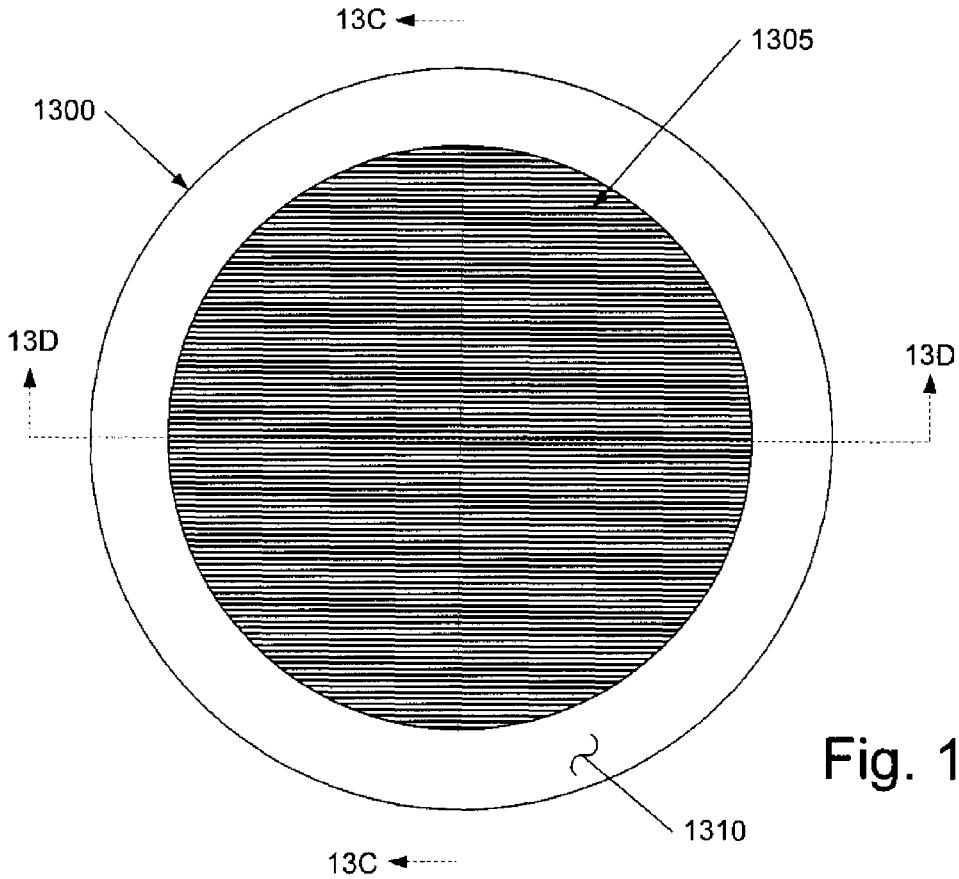
FIG. 13B is a top plan view of the liquid-distribution structure of FIG. 13A.
Figure 13C:
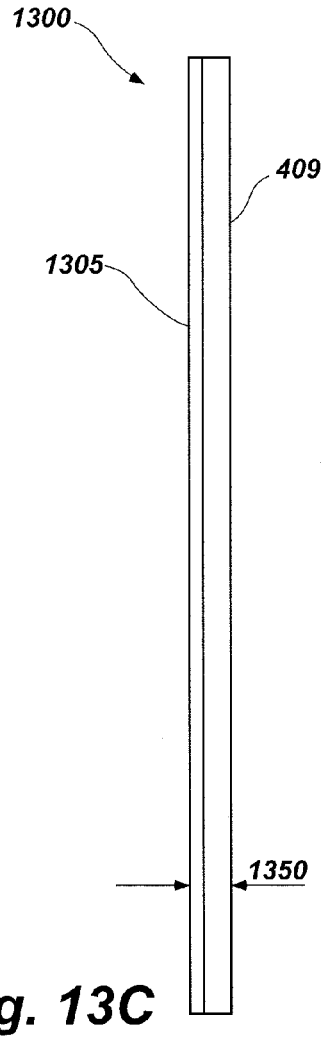
FIGS. 13C and 13D are cross-sectional views of the liquid-distribution device of FIG. 13A taken along section lines 13C-13C and 13D-13D, respectively, of the top plan view of FIG. 13A.
Figure 13D:
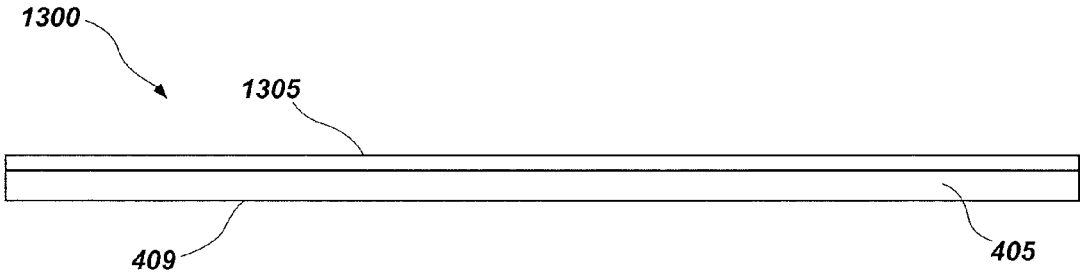
Figure 13E:
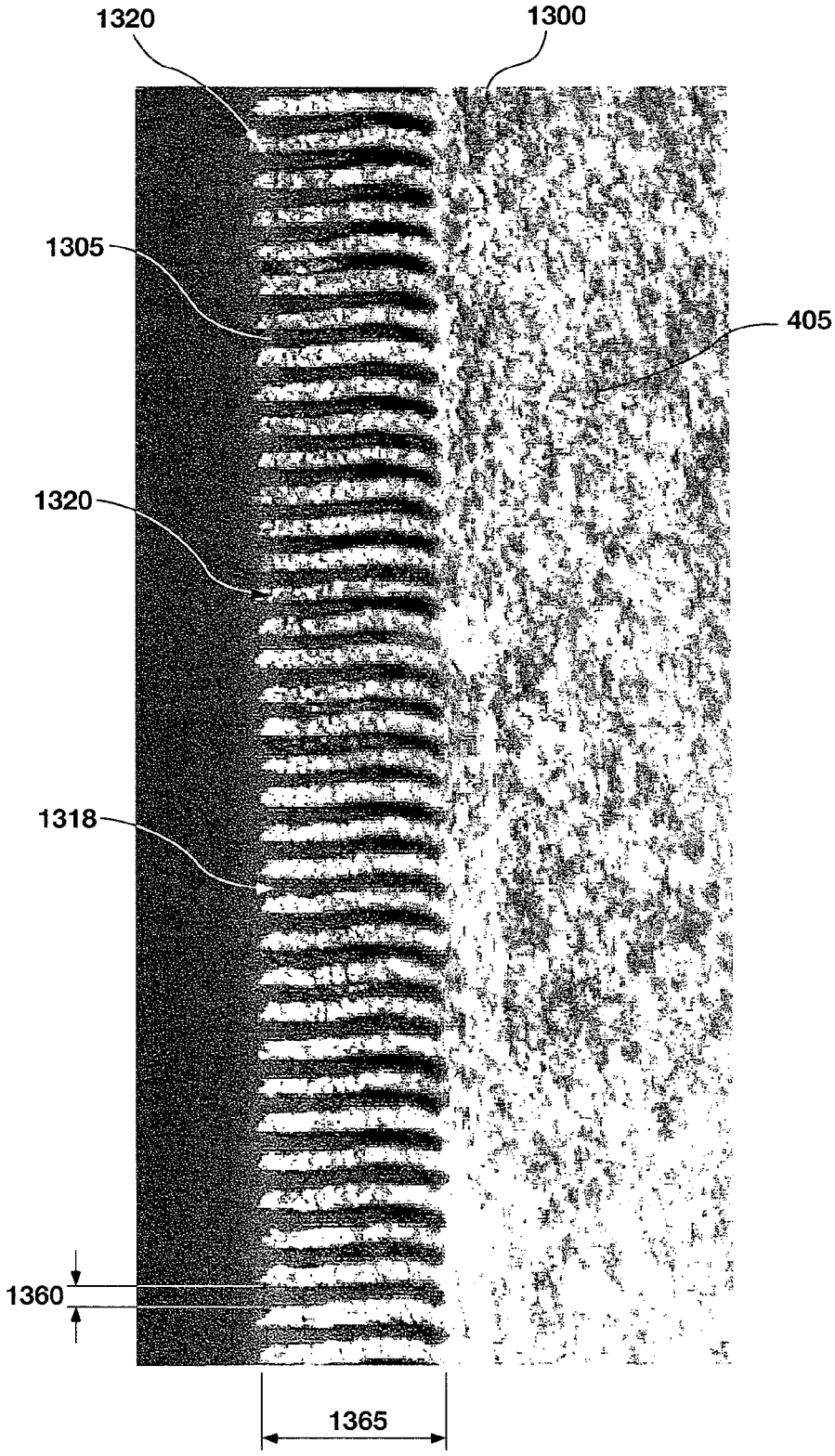
FIG. 13E is an enlarged side cross-sectional view of the liquid-distribution structure of FIG. 13C.

Referring also to FIGS. 13A through 13E, in a second implementation, the liquid-distribution structure 407 can be designed as a microchannel plate 1300 having microchannels 1305 formed along the vapor barrier wall 405. The microchannels 1305, shown in FIGS. 13A and 13B, are not drawn to scale and appear larger than actual size.

The microchannel plate 1300 has a thickness 1350 that is significantly smaller than a thickness of the wick 415. In this way, the vapor removal channel 1015 of the wick 415 is near the heat-receiving surface 409 of the vapor barrier wall 405. Thus, for example, if the wick 415 has a thickness 1050 of about 0.22 inch, the microchannel plate 1300 can have a thickness 1350 of about 0.06 inch. The microchannel plate 1300 can be made of any thermally conductive material to enable heat transfer from the heat source 110 and through the microchannel plate 1300. For example, the microchannel plate 1300 can be made of copper, the vapor barrier wall 405 can be made of copper, and the microchannels 1305 can be formed by narrow channels 1318 between projections 1320 that extend from the inner surface of the vapor barrier wall 405. The second surface 1005 of the wick 415 contacts the microchannel plate 1300 at the projections 1320. In one implementation, there are 120 projections 1320 per inch of surface 1310 such that each channel 1318 has a width 1360 of between about 12 μm to 15 μm and a depth 1365 of about 125 μm. The microchannel plate 1300 can be fabricated by Wolverine Tube, Inc., of Huntsville, Ala., available on the worldwide web at wlv.com.

Figure 14A:
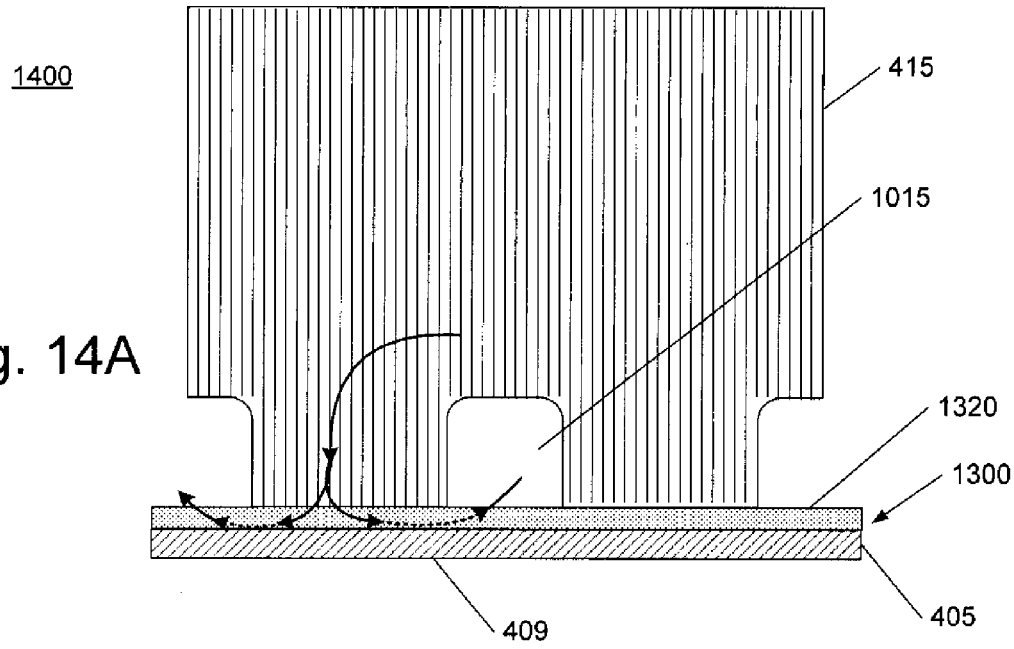
FIGS. 14A and 14B are enlarged cross-sectional views of the evaporator of FIGS. 4 and 5, respectively, with the liquid-distribution structure of FIG. 13A.
Figure 14B:
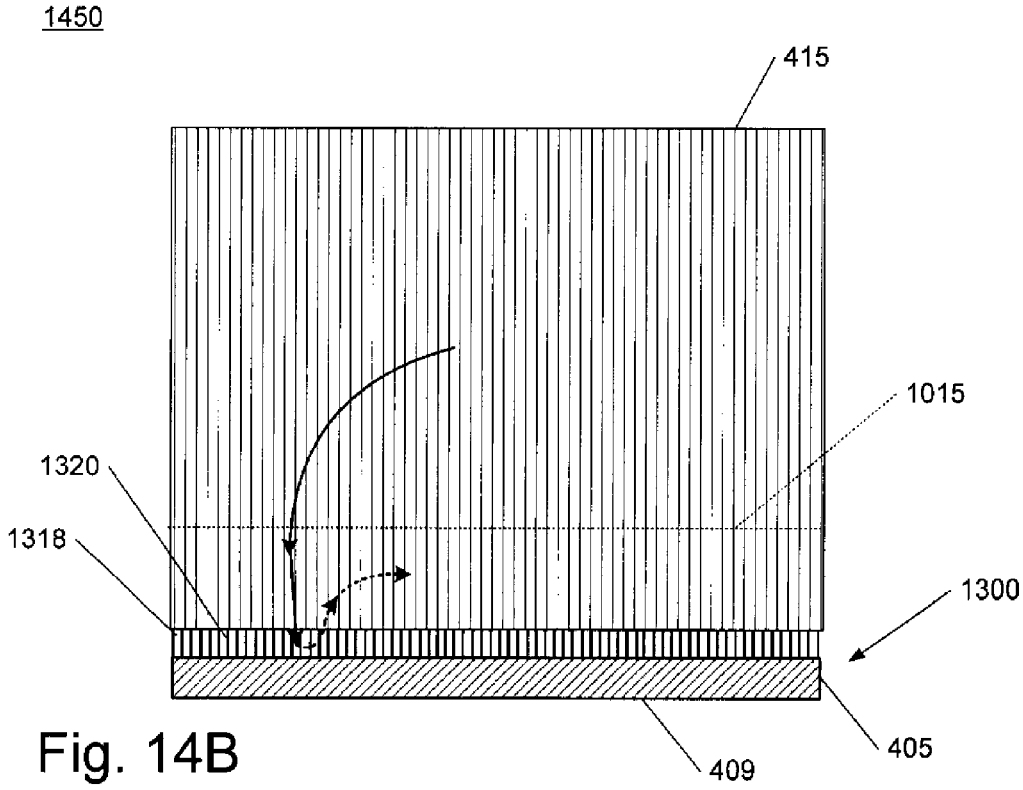

Referring to enlarged cross-sectional views 1400 and 1450 of FIGS. 14A and 14B, respectively, the interface between the microchannel plate 1300 and the wick 415 is shown. The vapor removal channels 1015 of the wick 415 extend generally along an axis that is non-parallel to (for example, perpendicular to) an axis along which the channels 1318 extend. The vapor removal channels 1015 are in fluid communication with at least a portion of the channels 1318 and the second surface 1005 of the wick 415 contacts the projections 1320 of the microchannel plate 1300.

In operation, liquid is fed into the evaporator 100 through the liquid inlet port 205 and into the fluid channel 920 of the sealing device 420. Liquid flows through the wick 415 from the sealing device 420, and the liquid feeds into the microchannel plate 1300 between the projections 1320 where the second surface 1005 of the wick 415 contacts the microchannel plate 1300. Liquid then flows through the gaps or the channels 1318 between the projections 1320, and toward the vapor removal channels 1015, where the liquid evaporates at the interface between the vapor removal channel 1015 and the microchannel plate 1300 to form a vapor. The vapor flows through the vapor removal channel 1015 to the vapor header channel 1010, out of the vapor outlet port 215, and into the vapor line 125. Moreover, vapor and or non-condensable gas bubbles formed at the interface between the wick 415 and the sealing device 420 can be swept out of the evaporator 100 (FIGS. 1A and 1B) through the fluid channel 920 and the fluid outlet port 210 and into the sweepage line 135.

In general, the surface of the liquid-distribution structure 407 (thin film device 1100 or microchannel plate 1300) that faces the wick 415 can be made with as large an area as possible to facilitate liquid transfer and evaporation. The liquid-distribution structure 407 allows evaporation at the surface of liquid-distribution structure 407 that does not contact the wick 415. Thus, if the liquid-distribution structure 407 is the thin film device 1100, then evaporation takes place within the vapor passages 1105 at the surface of the thin film device 1100 in those regions not contacting the contact regions 1210. If the liquid-distribution structure 407 is the microchannel plate 1300, then evaporation takes place within the channels 1318 formed between the projections 1320 and not at the contact region between the projections 1320 and the wick 415. Thus, the contact regions of the liquid-distribution structure 407 can be made as small as possible or can be optimized to provide sufficient evaporation surface area.

Figure 15:
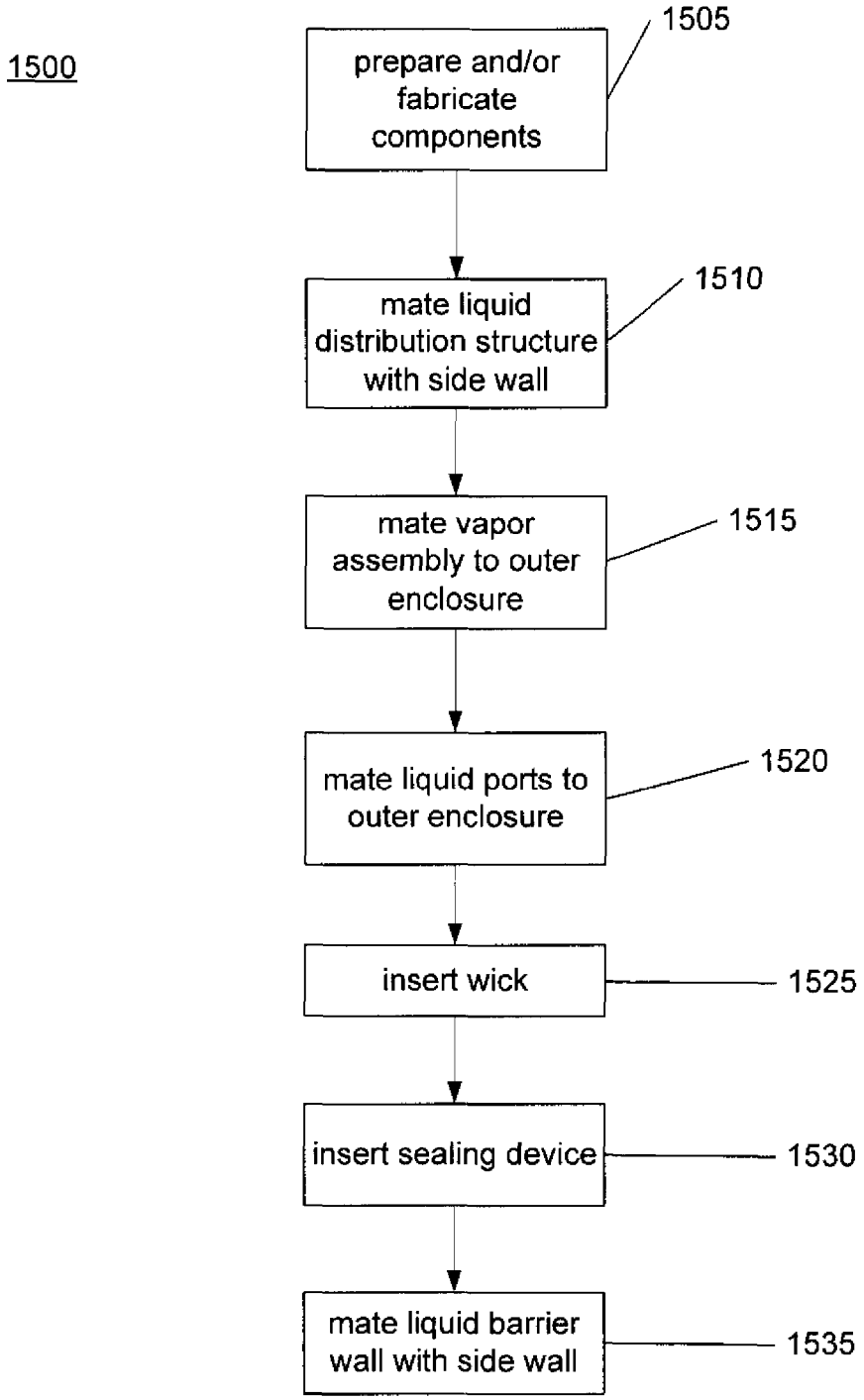
FIG. 15 is a procedure for manufacturing the evaporator of FIG. 2.

Referring to FIG. 15, the evaporator 100 (FIGS. 1A and 1B) can be fabricated according to a procedure 1500. Initially, all of the individual components of the evaporator 100, including the liquid barrier wall 400, the side wall 410, the sealing device 420, and the liquid-distribution structure 407 are fabricated and prepared for later steps (step 1505). Next, the liquid-distribution structure 407 is mated with the side wall 410 by inserting the structure 407 into a groove of the side wall 410 (step 1510). The groove of the side wall 410 may be prepared with a pre-form or a pre-solder before mating of the liquid-distribution structure 407 with the side wall 410. The vapor port tube 225 is fixed to the vapor port fitting 220 and the vapor port fitting 220 is inserted into the outer enclosure 200, for example, by inserting the vapor port fitting 220 into the side opening 605 of the side wall 410 (step 1515). The inlet ports 205, 207 are fixed to the outer enclosure 200, for example, by fixing the inlet ports 205, 207 to the liquid barrier wall 400 (step 1520). The inlet ports 205, 207 can be fixed to the outer enclosure 200 by, for example, soldering using a water-soluble flux. The components of the evaporator 100 can be cleaned before or after any of the steps during the procedure 1500, as needed. The wick 415 is inserted into the side wall 410 to contact the liquid-distribution structure 407 (step 1525), and the sealing device 420 is pressed into the side wall 410 to contact the wick 415 and ensuring that all fluid openings are appropriately aligned (step 1530). The liquid barrier wall 400 with the inlet ports 205, 207 is placed on top of and pressed into the side wall 410 to enclose the sealing device 420 and the wick 415 (step 1535). During this step, the sealing device 420 can be compressed much like a gasket to provide sealing of the liquid barrier wall 400 to the side wall 410. Next, the joints can be welded to hermitically seal the outer enclosure 200.

The microchannels 1305 or the porous device 1102 of the liquid-distribution structure 407 can be fabricated independently from the vapor barrier wall 405, and then the microchannels 1305 or the porous device 1102 can be bonded to the surface of the vapor barrier wall 405 by a suitable joining method that ensures efficient heat transfer between the vapor barrier wall 405 and the microchannels 1305 or the porous device 1102. The microchannels 1305 can be fabricated as an integral part of and with the vapor barrier wall 405. The porous device 1102 can be fabricated by sintering copper powder onto a copper vapor barrier wall 405.

Other implementations are within the scope of the following claims. For example, the wick 415 can be designed to extend the entire length from the liquid barrier wall 400 to the vapor barrier wall 405, and the evaporator 100 can be designed without the sealing device 420.

Figure 16A:
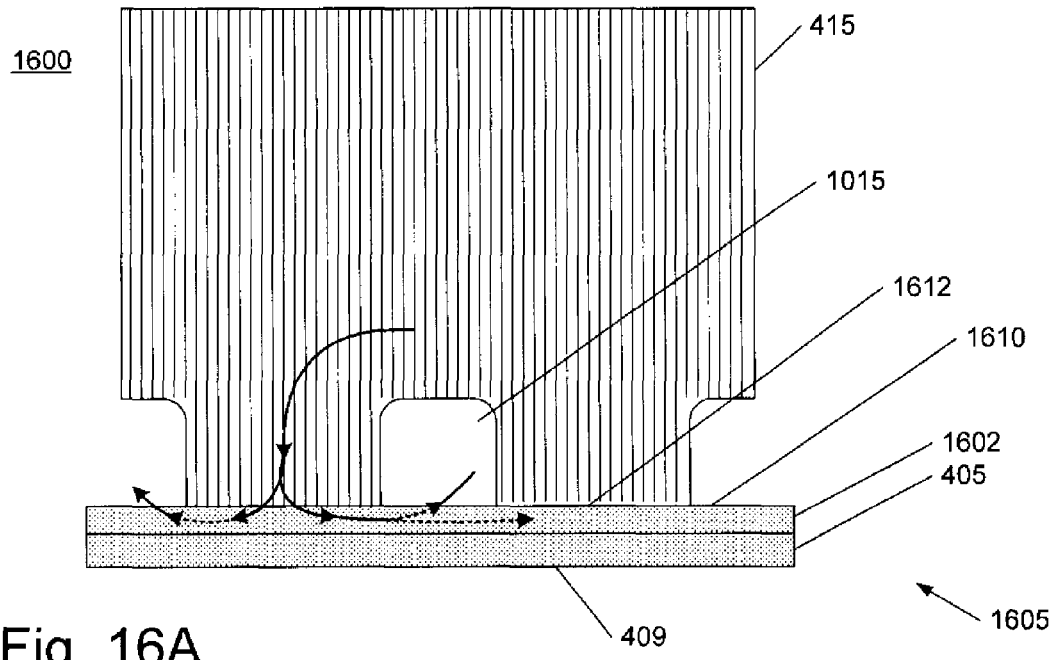
FIGS. 16A and 16B are enlarged cross-sectional views of the evaporator of FIGS. 4 and 5, respectively, with another implementation of a liquid-distribution structure.
Figure 16B:
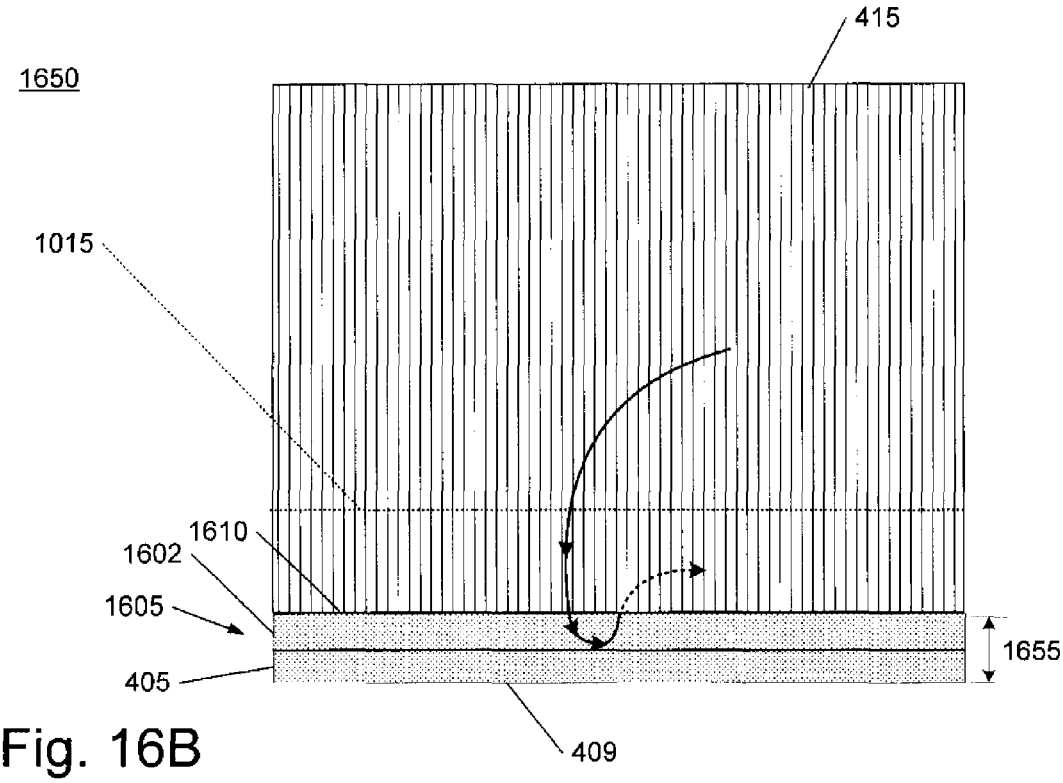

Referring to FIGS. 16A and 16B, in other implementations (e.g., 1600, 1650), the liquid-distribution structure 407 can be designed as a thin film device 1605 that does not include vapor passages (like the vapor passages 1105 in thin film device 1100) formed along an inner surface of the thin film device 1605 but rather has a flat inner surface 1610. The thin film device 1605 includes a porous device 1602 linked or joined to the vapor barrier wall 405. The porous device 1602 has a pore size large enough to permit liquid flow, and has a high thermal conductivity. The thin film device 1605 has a thickness 1655 that is significantly smaller than a thickness of the wick 415. Thus, for example, if the wick 415 has a thickness 1050 of about 0.22 inch, the thin film device 1605 can have a thickness 1655 of about 0.06 inch and a pore size of about 2 μm to 4 μm. The vapor removal channel 1015 is situated near the heat-receiving surface 409 of the vapor barrier wall 405. The thin film device 1605 can be made of any thermally conductive material to enable heat transfer from the heat source 110 and the vapor barrier wall 405. For example, the thin film device 1605 can be made of copper having a 35% porosity.

The pores of the thin film device 1605 are in fluid communication with the second surface 1005 of the wick 415 that contacts the inner surface 1610 of the thin film device 1605 at regions 1612. In operation, liquid is fed into the evaporator 100 through the liquid inlet port 205 and into the fluid channel 920 of the sealing device 420. Liquid flows through the wick 415 from the sealing device 420, and the liquid feeds into the thin film device 1605 across the regions 1612 where the second surface 1005 of the wick 415 contacts the inner surface 1610 of the thin film device 1605. Liquid then flows through the pores of the thin film device 1605 and toward the vapor removal channels 1015 of the wick 415, where the liquid evaporates at the interface between the vapor removal channel 1015 and the thin film device 1605 to form a vapor. The vapor flows through the vapor removal channel 1015 to the vapor header channel 1010, out of the vapor outlet port 215, and into the vapor line 125. Moreover, vapor and or non-condensable gas bubbles formed at the interface between the wick 415 and the sealing device 420 can be swept out of the evaporator 100 through the fluid channel 920 and the fluid outlet port 210 and into the sweepage line 135. As shown above, the evaporator 100 has a planar profile, that is, a planar vapor barrier wall 405, a planar wick 415, and a planar liquid barrier wall 400. Such a design is suitable for many applications, such as an application in which a heat source 110 is planar. Additionally, the evaporators described above have circular footprints to match the shape of a cylindrical heat source 110. But, other geometries for the evaporator 100 are possible. For example, the evaporator 100 can be polygonal, elliptical, or non-symmetrical.

Figure 17:
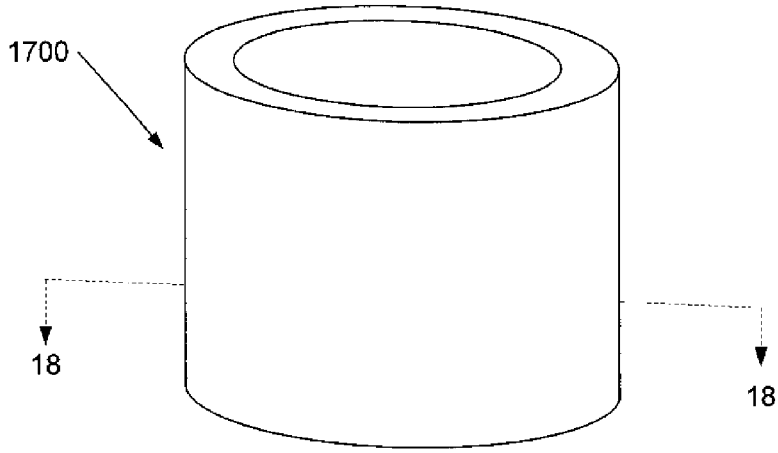
FIG. 17 is a perspective view of another implementation of an evaporator that can be used in the heat transfer system of FIG. 1.
Figure 18:
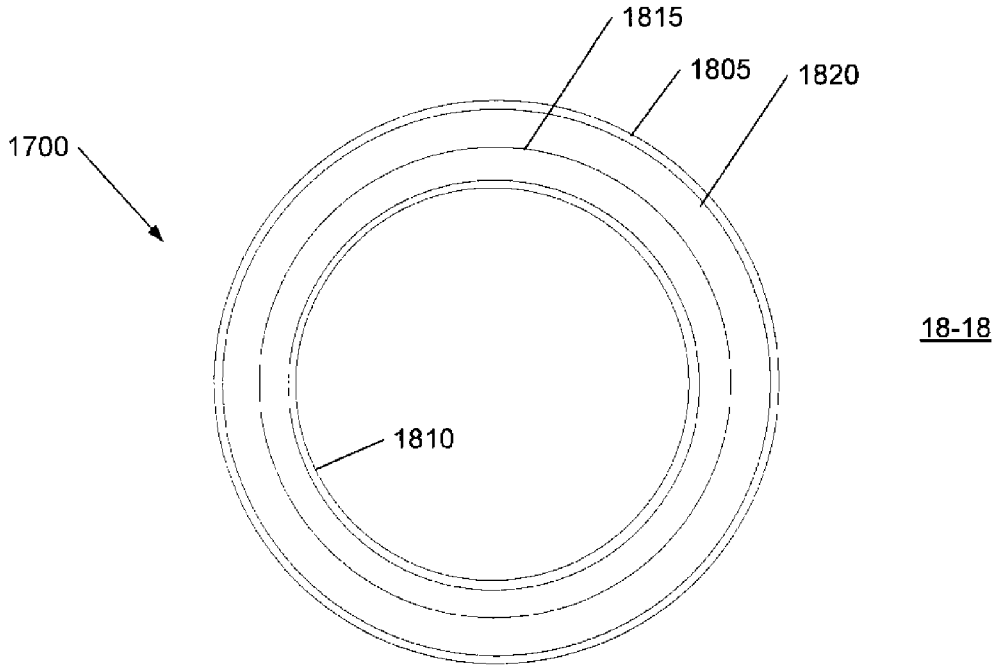
FIG. 18 is a cross-sectional view of the evaporator of FIG. 17 taken along section line 18-18.

Referring to FIGS. 17 and 18, a non-planar looped evaporator such as an annular evaporator 1700 may be formed by removing the side wall 410 and effectively rolling the planar evaporator 100 such that the wick 415, the liquid barrier wall 400, and the liquid-distribution structure 407 loop back on themselves and form a looped or annular shape. The evaporator 1700 includes a liquid barrier wall 1805 and a liquid-distribution structure 1810 that define the chamber that houses the working fluid, a wick 1815, and, if needed, a sealing device 1820.

An annular evaporator can be used in applications in which the heat sources have a cylindrical exterior profile, or in applications in which the heat source can be shaped like a cylinder. Alternatively, a looped profile that has a non-circular cross-section could be used in applications in which the heat sources have a non-circular exterior profile.

Referring to FIGS. 19A through 19F, in another implementation, the high heat flux evaporator 100 (FIGS. 1A and 1B) can be designed like an evaporator 1900. The evaporator 1900 includes an outer enclosure 1902, a liquid inlet port 1905 extending through the outer enclosure 1902, a fluid outlet port 1910 extending from the outer enclosure 1902, and a vapor outlet port 1915 extending from the outer enclosure 1902. The outer enclosure 1902 includes a liquid barrier wall 1920, and a liquid-distribution structure 1927 that includes a vapor barrier wall 1925 that is sealed to the liquid barrier wall 1920 to form a fluidly sealed hermetic chamber for working fluid. The evaporator 1900 includes a wick 1930 positioned between the liquid barrier wall 1920 and the liquid-distribution structure 1927. The evaporator 1900 can also include a sealing device 1935 positioned between the wick 1930 and the inner side of the liquid barrier wall 1920.

The liquid-distribution structure 1927 has a low thermal impedance and, therefore, a high thermal conductivity. In particular, the vapor barrier wall 1925 and the liquid-distribution structure 1927 have a thermal impedance that is lower than a thermal impedance of the wick 1930. In this way, heat from the heat source 110 is able to freely pass through the vapor barrier wall 1925 and through the liquid-distribution structure 1927 but heat is not as free to pass through the wick 1930. Thus, the heat is localized at an interface between the liquid-distribution structure 1927 and the wick 1930. Additionally, the liquid-distribution structure 1927 distributes liquid by pumping the liquid through the wick 1930 to and along the surface of the vapor barrier wall 1925 for better heat distribution, as discussed above.

Figure 19A:
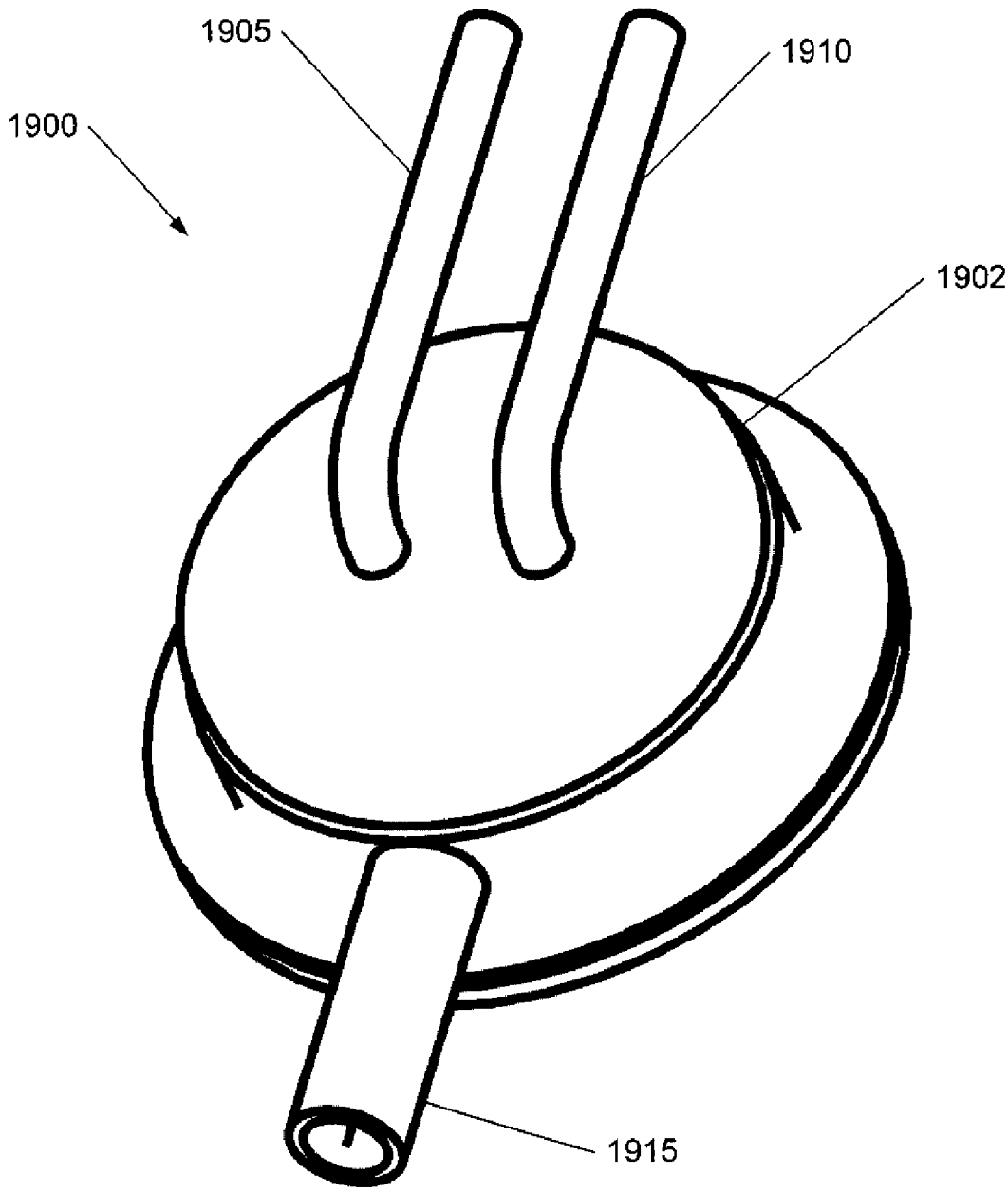
FIG. 19A is a perspective view of another implementation of an evaporator that can be used in the heat, transfer system of FIG. 1.
Figure 19B:
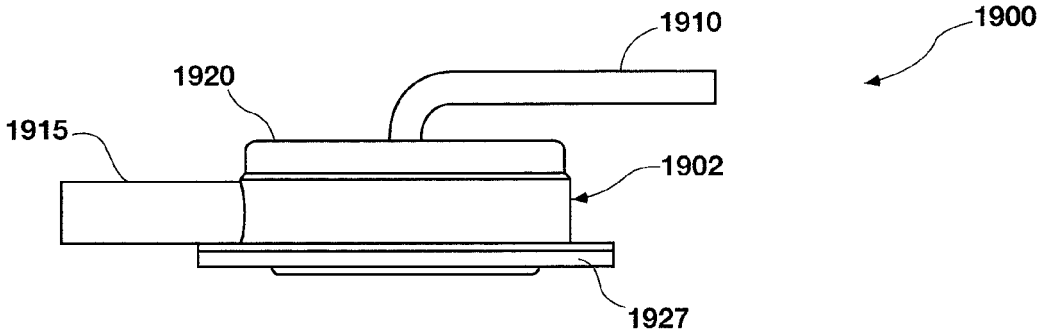
FIGS. 19B through 19D are, respectively, side, bottom, and front plan views of the evaporator of FIG. 19A.
Figure 19C:
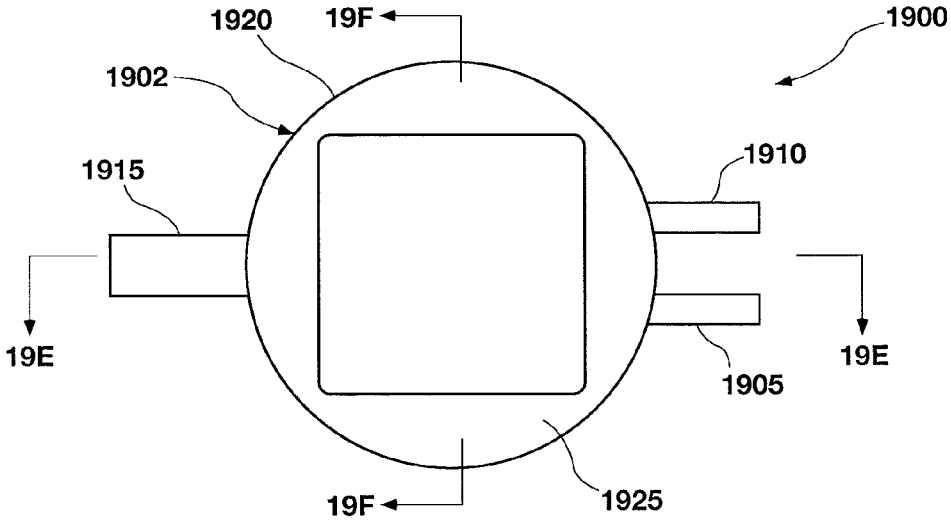
Figure 19D:
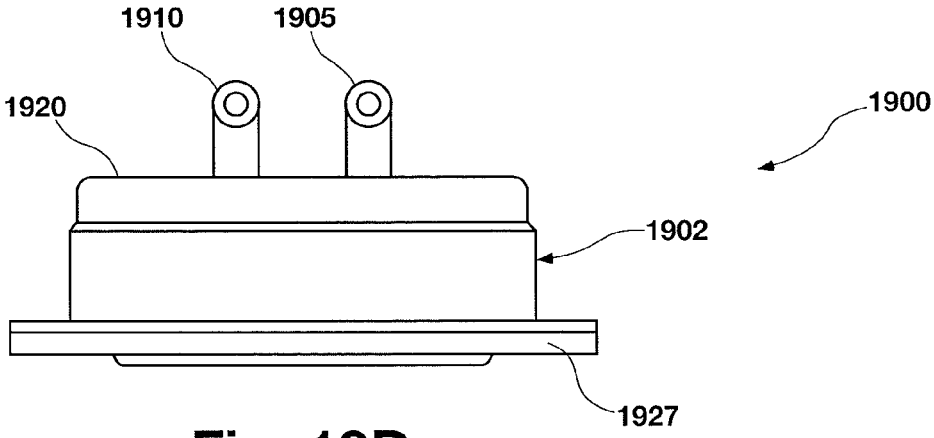
Figure 19E:
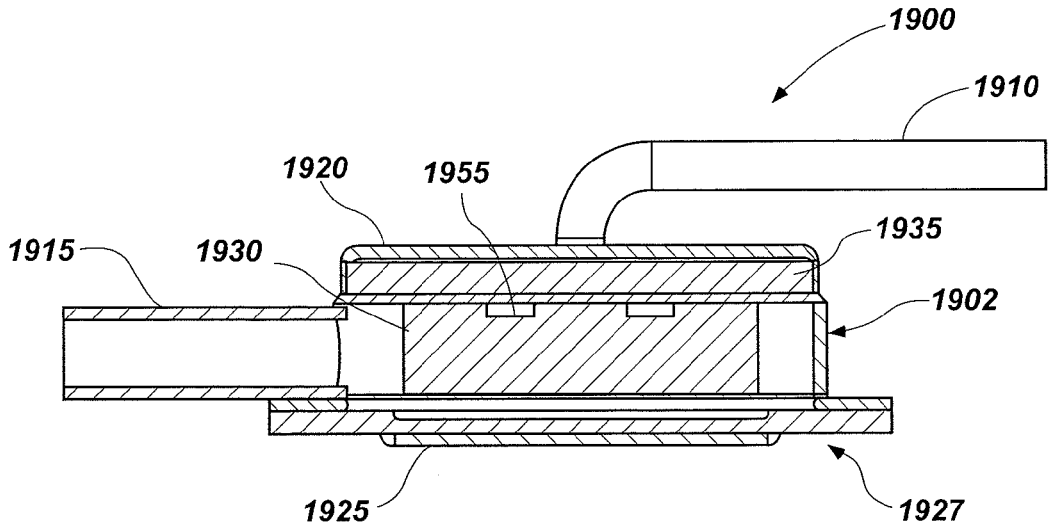
FIGS. 19E and 19F are cross-sectional views of the evaporator of FIG. 19C taken along section lines 19E-19E and 19F-19F, respectively.
Figure 19F:
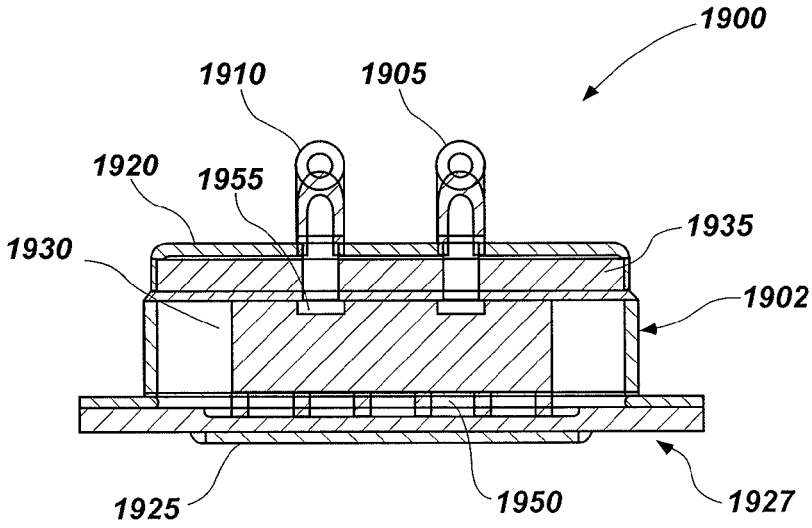
Figure 19G:
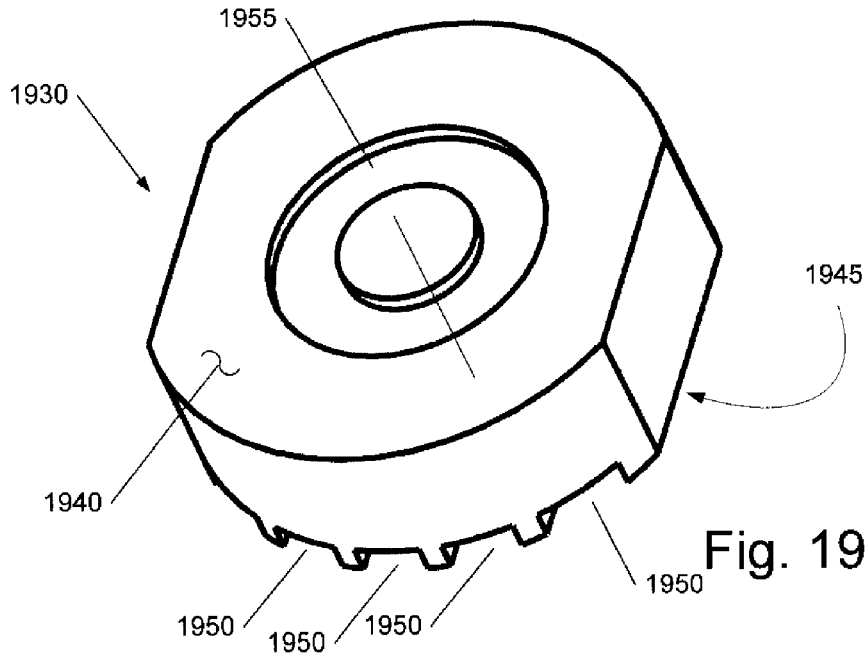
FIG. 19G is a perspective view of a wick for use in the evaporator of FIG. 19A.
Figure 19I:
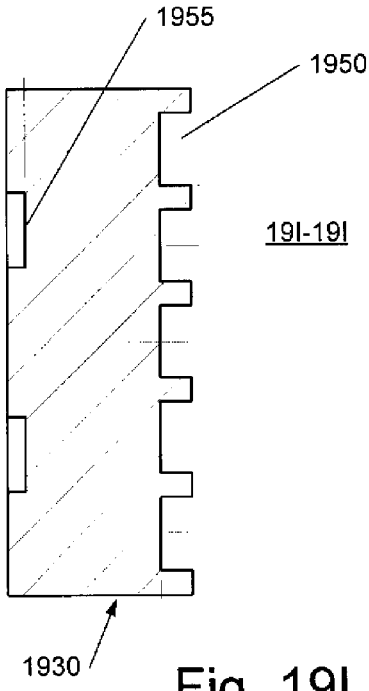
FIG. 19I is a cross-sectional view of the wick of FIG. 19H taken along section line 19I-19I.
Figure 19H:
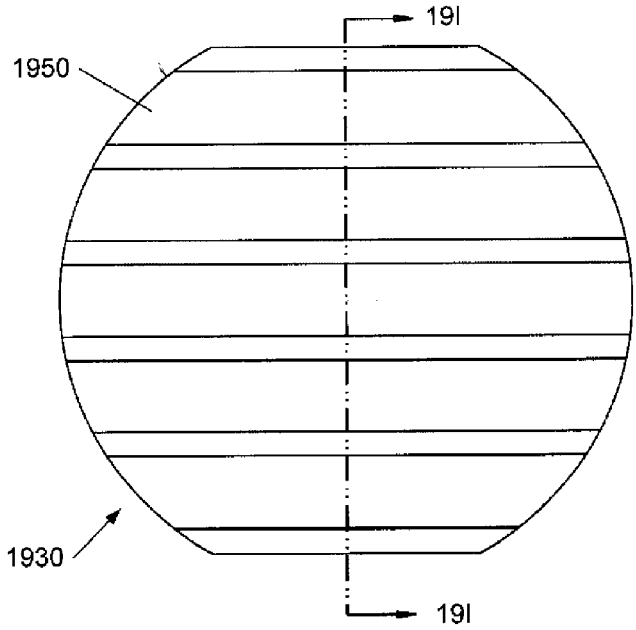
FIG. 19H is a bottom plan view of the wick of FIG. 19G.

Referring also to FIGS. 19G through 19I, the wick 1930 has a first surface 1940 and a second surface 1945. The first surface 1940 is generally flat and contacts the sealing device 1935 when the evaporator 1900 is assembled. The second surface 1945 is generally flat and contacts the vapor barrier wall 1925 when the evaporator 1900 is assembled. The second surface 1945 includes one or more vapor flow channels 1950 in fluid communication with the vapor barrier wall 1925 and one or more fluid flow channels 1955. The wick 1930 is made of a material having a low thermal conductivity to reduce heat conduction from the liquid-distribution structure 1927 to the sealing device 1935 and having a pore size sufficient for fluid flow across the wick 1930. For example, in one implementation, the wick 1930 is made of a non-metallic material such as polyetheretherketone (PEEK™), a thermoplastic resin manufactured by Victrex plc., West Conshohocken, Pa. PEEK™ also has low friction, dimensional stability, low outgassing, and exhibits good machinability. In one implementation, a thermal conductivity of PEEK™ is 0.23 W/m-K. As another example, the wick 1930 can be made of ceramic, PTFE, or any other suitable plastic.

The fluid channel 920 formed between the wick 415 and the sealing device 420 can have any suitable cross-sectional shape, for example, triangular, semicircular, curved, polygonal, or irregular.

The evaporator 100 can be used within any suitable two-phase loop heat transfer system to cool electronic, electro-optical, and optical devices such as, for example, semiconductor chips and lasers. The evaporator described above can be used in any two-phase loop heat transfer system, including, for example, a CPL, an LHP, a hybrid LHP, or a multiple-evaporator hybrid LHP.

Figure 20:
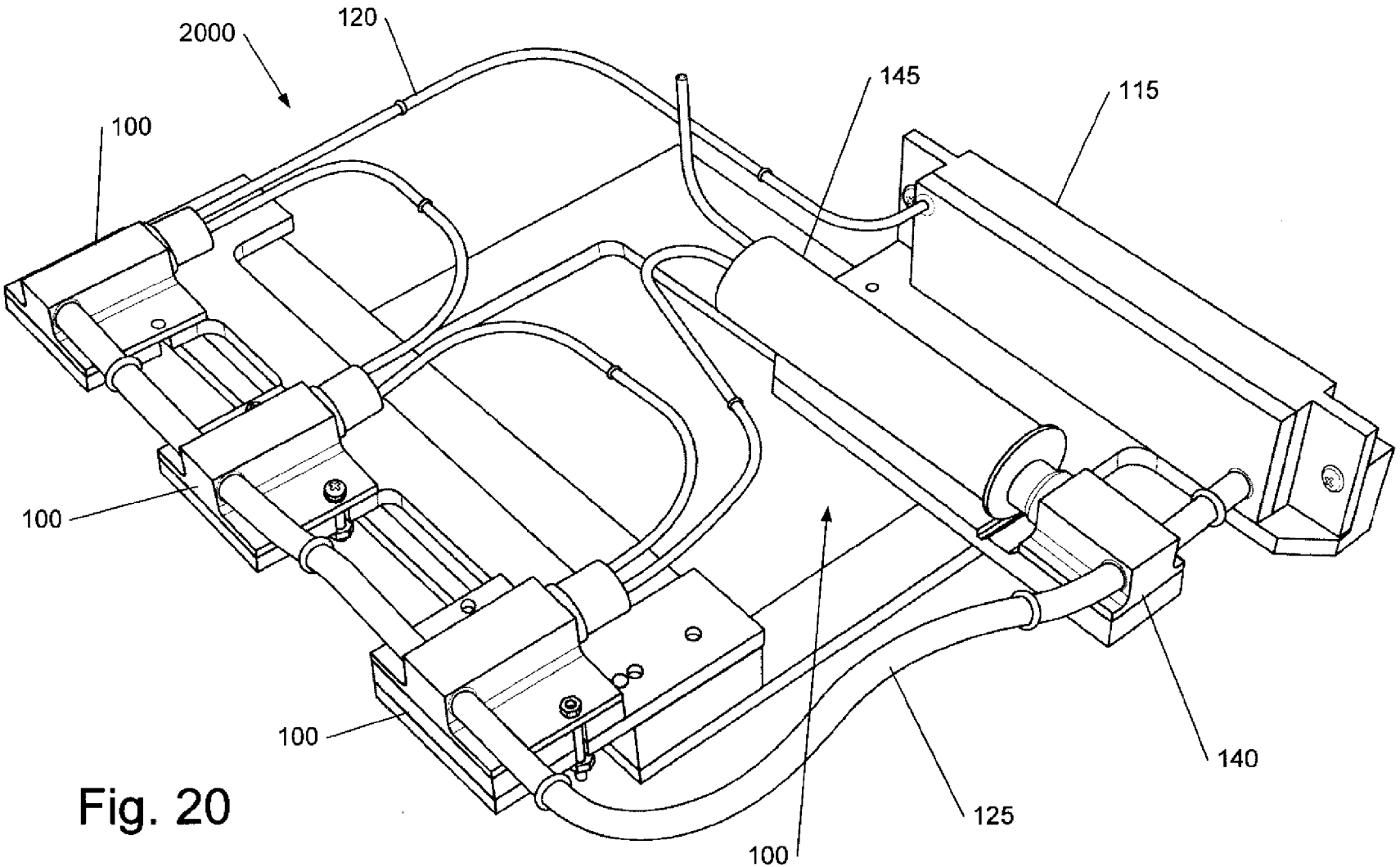
FIG. 20 is a perspective view of a heat transfer system in which the evaporators of FIGS. 2 through 19I can be used.

For example, referring to FIG. 20, three evaporators 100 are included in a two-phase loop heat transfer system 2000. The evaporators 100 are arranged in a series such that one of the evaporators 100 is coupled to the liquid line 120 from the condenser 115 and one of the evaporators 100 is coupled to the vapor line 125 to the condenser 115. The system 2000 includes the secondary system 130 coupled to one of the evaporators 100 through the sweepage line 135. The secondary system 130 includes the secondary evaporator 140 and the reservoir 145 thermally and hydraulically coupled to the secondary evaporator 140.

In another implementation, while not shown in FIG. 20, the evaporators 100 can be arranged in parallel relative to the liquid line 120.

As shown in FIG. 5, the liquid inlet port 205 or 207 extends through the liquid barrier wall 400. In other implementations, the liquid inlet port 205 or 207 can, instead, extend through the side wall 410.

Figure 21:
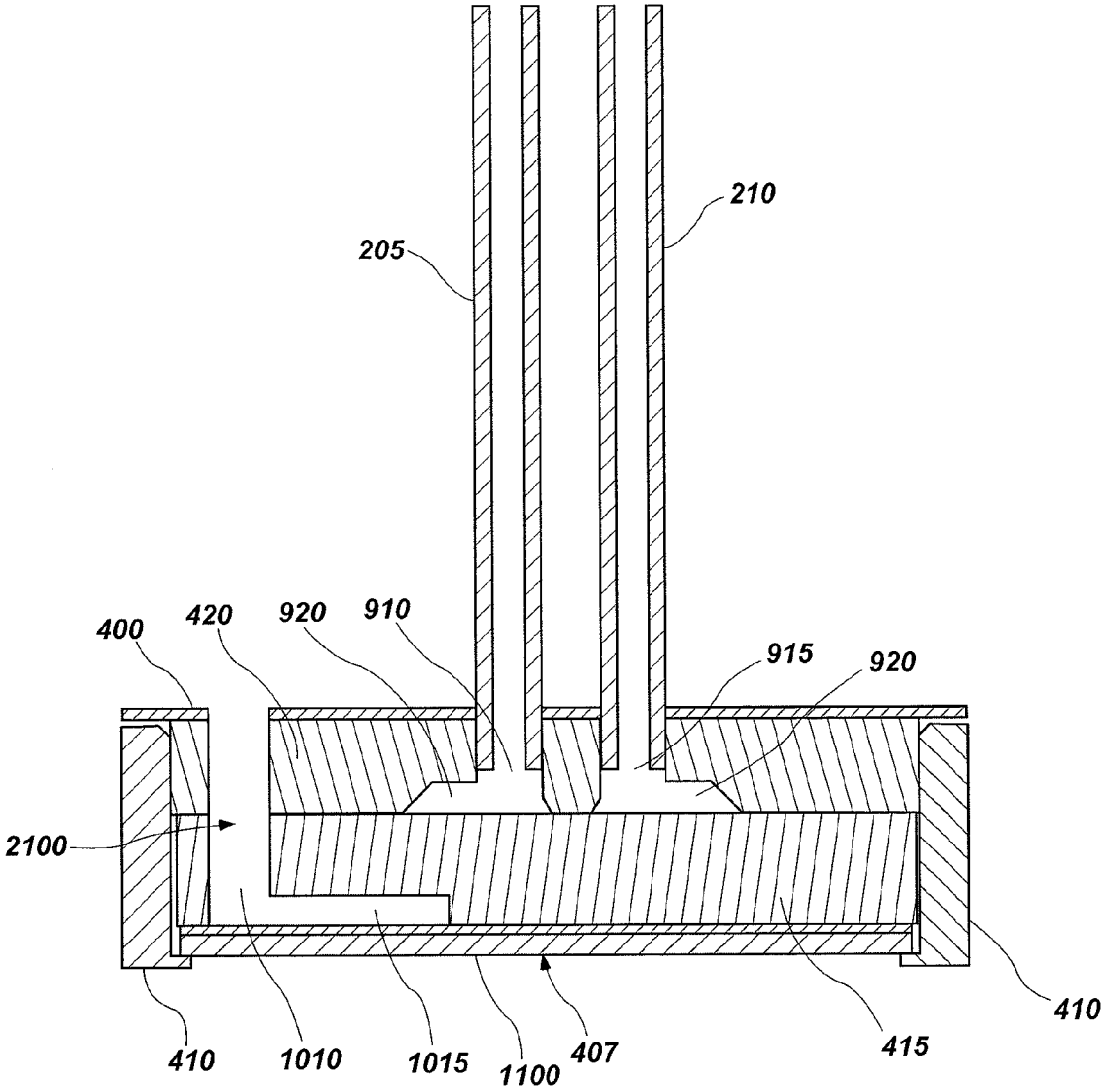
FIG. 21 is a cross-sectional view of another implementation of the evaporator of FIG. 3 taken along section line 5-5.

Referring to FIG. 21, the vapor header channel 1010 is in fluid communication with an opening 2100 that extends through the wick 415, the liquid barrier wall 400, and through the sealing device 420, if the sealing device 420 is included. In this design, the side wall 410 has a generally cylindrical shape that does not include the side opening 605. Instead, the opening 2100 fluidly couples with the vapor outlet port 215.

Figure 22:
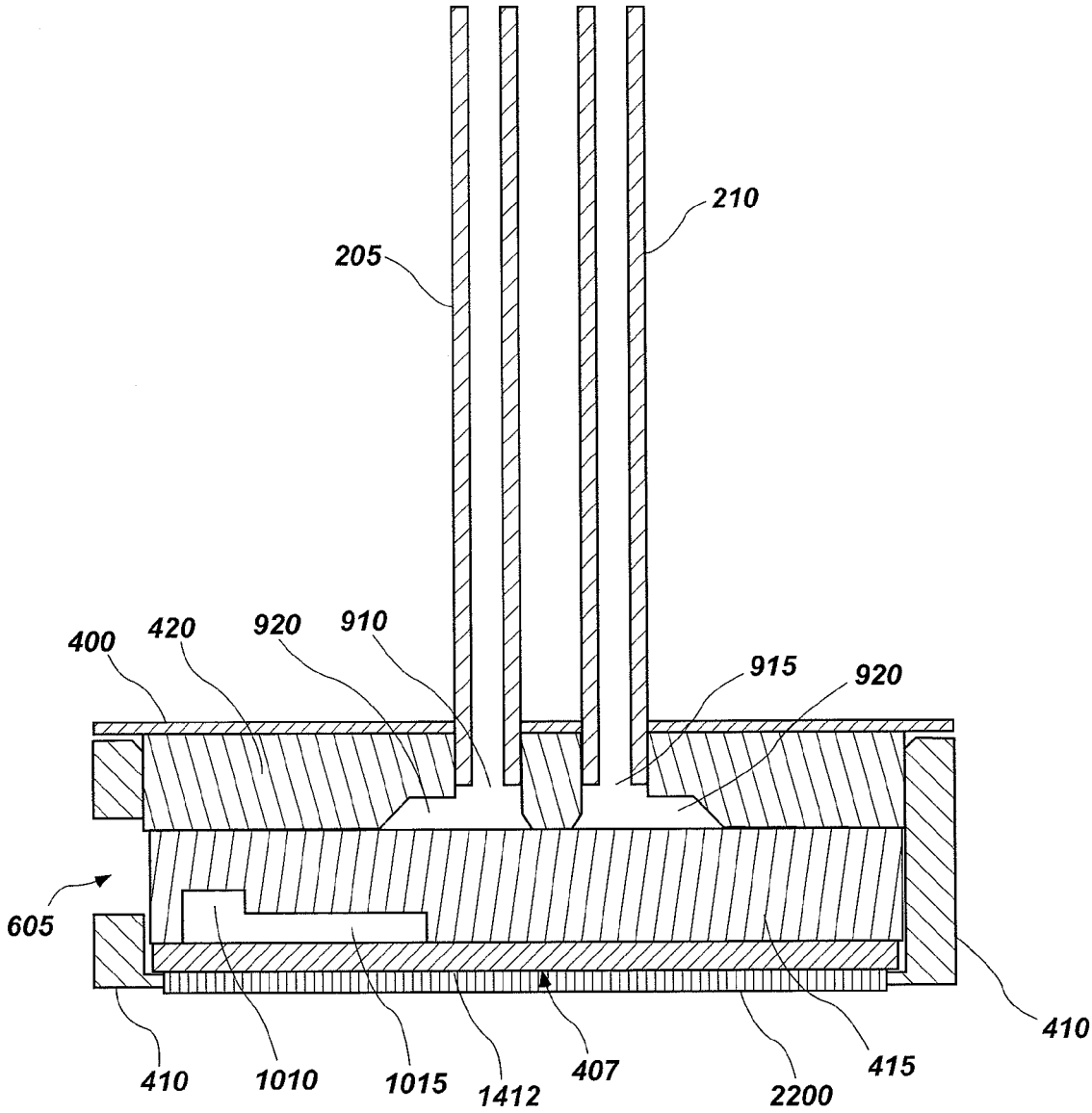
FIG. 22 is a cross-sectional view of another implementation of the evaporator of FIG. 3 taken along section line 5-5.

Referring to FIG. 22, in another implementation, the evaporator 100 can include a heat-receiving wall 2200 positioned to thermally link to the liquid-distribution structure 407 and to contact the heat source 110 (FIGS. 1A and 1B).

What is claimed is:

1. An evaporator comprising:

an outer fluid enclosure;

a liquid inlet port coupled through the outer fluid enclosure;

a liquid-distribution structure joined to the outer fluid enclosure to form a fluidly sealed hermetic chamber, the liquid-distribution structure including a vapor barrier wall having an outer heat-receiving surface and being configured to distribute liquid over an inner surface of the vapor barrier wall;

a wick positioned inside the fluidly sealed hermetic chamber and being coupled to the liquid inlet port;

at least one vapor removal channel formed in the wick and being in fluid communication with the liquid-distribution structure, and being near the outer heat-receiving surface of the vapor barrier wall; and a vapor header channel formed in the wick and being transverse to the at least one vapor removal channel, the at least one vapor removal channel extending from and being in communication with the vapor header channel;

wherein a thermal conductance of the liquid-distribution structure is higher than a thermal conductance of the wick.

2. The evaporator of claim 1, wherein the outer fluid enclosure includes a liquid barrier wall positioned such that the wick is between the liquid barrier wall and the liquid-distribution structure.

3. The evaporator of claim 2, further comprising a liquid flow channel formed in the liquid barrier wall and in fluid communication with the at least one vapor removal channel.

4. The evaporator of claim 2, wherein the liquid barrier wall includes at least one segment that has a conductivity that is lower than a conductivity of the wick.

5. The evaporator of claim 2, wherein the liquid barrier wall is made, at least in part, of a nickel alloy, stainless steel, ceramic, or plastic.

6. The evaporator of claim 2, wherein the liquid barrier wall includes at least one segment that is thinner than a remainder of the liquid barrier wall.

7. The evaporator of claim 1, further comprising a liquid flow channel positioned adjacent the wick and in fluid communication with the liquid inlet port.

8. The evaporator of claim 7, wherein the at least one vapor removal channel is remote from the liquid flow channel.

9. The evaporator of claim 7, wherein the liquid flow channel is remote from the outer fluid enclosure.

10. The evaporator of claim 9, further comprising a sealing device positioned between the outer fluid enclosure and the liquid flow channel, wherein the liquid flow channel is defined between the sealing device and the wick.

11. The evaporator of claim 1, wherein the at least one vapor removal channel is remote from the liquid inlet port.

12. The evaporator of claim 1, wherein the liquid-distribution structure comprises a porous device.

13. The evaporator of claim 12, wherein the porous device is bonded to the vapor barrier wall.

14. The evaporator of claim 12, wherein the porous device is formed integrally with the vapor barrier wall.

15. The evaporator of claim 12, wherein the porous device is made of the same material as the vapor barrier wall.

16. The evaporator of claim 12, wherein the porous device is sintered to the vapor barrier wall.

17. The evaporator of claim 12, wherein the porous device includes vapor passages and pores having a size sufficient to distribute liquid and wherein the porous device is in fluid communication with the vapor passages.

18. The evaporator of claim 17, wherein the at least one vapor removal channel is in fluid communication with at least some of the vapor passages of the liquid-distribution structure.

19. The evaporator of claim 1, wherein the wick is in fluid communication with at least a portion of the liquid-distribution structure.

20. The evaporator of claim 1, wherein a thickness of the wick is greater than a thickness of the liquid-distribution structure.

21. The evaporator of claim 1, wherein the wick and the liquid-distribution structure contact each other at a region that is smaller than a surface area of the liquid-distribution structure that faces the wick.

22. The evaporator of claim 1, wherein the outer fluid enclosure includes a liquid barrier wall and a side wall coupled to the liquid barrier wall.

23. The evaporator of claim 22, wherein the liquid inlet port extends through the liquid barrier wall.

24. The evaporator of claim 22, wherein the liquid inlet port extends through the side wall.

25. The evaporator of claim 1, further comprising a fluid outlet port through the outer fluid enclosure for sweepage of vapor and non-condensable gas within the liquid.

26. The evaporator of claim 1, wherein:

the outer fluid enclosure is cylindrical; and the liquid-distribution structure and the wick are planar.

27. The evaporator of claim 1, wherein:

the outer fluid enclosure is annular; and the wick and the liquid-distribution structure are annular.

28. The evaporator of claim 1, wherein the liquid-distribution structure comprises microchannels along a surface of the vapor barrier wall.

29. The evaporator of claim 28, wherein the at least one vapor removal channel is in fluid communication with at least some of the liquid-distribution structure microchannels.

30. The evaporator of claim 28, wherein the microchannels are formed into the vapor barrier wall at an inner surface of the vapor barrier wall.

31. The evaporator of claim 28, wherein the wick is in fluid communication with at least some of the liquid-distribution structure microchannels.

32. The evaporator of claim 31, wherein the at least one vapor removal channel is in direct fluid communication with an evaporation interface defined within the microchannels.

33. An evaporator comprising:

a liquid barrier wall;

a liquid inlet port through the liquid barrier wall;

a liquid-distribution structure including:

a vapor barrier wall having an outer heat-receiving surface; and a porous device including vapor passages and pores having a size sufficient to distribute liquid and being in fluid communication with the vapor passages; and a wick positioned between the liquid barrier wall and the liquid-distribution structure and coupled to the liquid inlet port, the wick comprising:

one or more vapor removal channels formed in the wick, and being in fluid communication with at least some of the vapor passages; and a vapor header channel formed in the wick and being transverse to at least one of the one or more vapor removal channels, at least one of the one or more vapor removal channels extending from and being in communication with the vapor header channel;

wherein a thermal conductance of the liquid-distribution structure is higher than a thermal conductance of the wick.

34. The evaporator of claim 33, wherein the pores of the liquid-distribution structure are sized to provide pumping of the liquid from the wick.

35. The evaporator of claim 33, wherein the pores of the liquid-distribution structure have a size that is smaller than a size of pores of the wick.

36. An evaporator comprising:

a liquid barrier wall;

a liquid inlet port through the liquid barrier wall;

a fluid outlet port through the liquid barrier wall;

a liquid-distribution structure including:

a vapor barrier wall having an outer heat-receiving surface; and microchannels along an inner surface of the vapor barrier wall;

a wick positioned between the liquid barrier wall and the liquid-distribution structure and being coupled to the liquid inlet port;

a sealing device positioned between the wick and the liquid barrier wall, the sealing device comprising at least one fluid channel formed in the sealing device, the at least one fluid channel being in direct fluid communication with the liquid inlet port and the fluid outlet port; and one or more vapor removal channels defined at an interface between the wick and the liquid-distribution structure, and being in fluid communication with at least some of the liquid-distribution structure microchannels;

wherein a thermal conductance of the liquid-distribution structure is higher than a thermal conductance of the wick.

37. The evaporator of claim 36, wherein the wick and the liquid-distribution structure contact each other at contact regions that are smaller than a surface area of the wick that faces the liquid-distribution structure.

38. The evaporator of claim 37, wherein the microchannels adjacent the vapor barrier wall flow across the contact regions.

39. An evaporator comprising:

an outer fluid enclosure;

a liquid inlet port coupled through the outer fluid enclosure;

a fluid outlet port coupled through the outer fluid enclosure;

a liquid-distribution structure coupled to the outer fluid enclosure to define a fluidly sealed hermetic chamber and including a vapor barrier wall having an outer heat-receiving surface, the liquid-distribution structure being configured to distribute liquid over the vapor barrier wall;

a wick positioned inside the fluidly sealed hermetic chamber and being coupled to the liquid inlet port;

a sealing device positioned between the wick and the liquid barrier wall, the sealing device comprising at least one fluid channel formed in the sealing device, the at least one fluid channel being in direct fluid communication with the liquid inlet port and the fluid outlet port; and a vapor removal channel formed in the wick and being in fluid communication with the liquid-distribution structure, and being in direct fluid communication with an evaporation interface defined between the liquid-distribution structure and the wick.

40. An evaporator comprising:

a liquid barrier wall;

a liquid inlet port coupled through the liquid barrier wall;

a vapor barrier wall extending along a vapor barrier plane;

a wick positioned between the liquid barrier wall and the vapor barrier wall, the wick coupled to the liquid inlet port;

a liquid flow channel located between the liquid barrier wall and the wick, the liquid flow channel fluidly coupled to the liquid inlet port;

at least one vapor removal channel that is located at an interface region between the wick and the vapor barrier wall and that extends along the vapor barrier plane in a first direction;

a vapor header channel that is located at the interface region between the wick and the vapor barrier wall, the vapor header channel extending along the vapor barrier plane, being in direct fluid communication with the at least one vapor removal channel, and being transverse to the first vapor removal channel; and a vapor outlet port in direct fluid communication with the vapor header channel.

41. A heat transfer system comprising:

an evaporator comprising:

an outer fluid enclosure;

a liquid inlet port coupled through the outer fluid enclosure;

a liquid-distribution structure coupled to the outer fluid enclosure to define a fluidly sealed hermetic chamber, the liquid-distribution structure comprising:

a planar vapor barrier wall having an outer heat-receiving surface and an inner surface; and a plurality of channels coupled to the vapor barrier wall and configured to distribute liquid over the inner surface of the vapor barrier wall;

a planar wick positioned inside the fluidly sealed hermetic chamber and being coupled to the liquid inlet port; a sealing device positioned adjacent to the planar wick, the sealing device comprising at least one fluid channel formed in the sealing device, the at least one fluid channel being in direct fluid communication with the liquid inlet port; and a vapor removal channel formed in a side of the wick in contact with the liquid-distribution structure and being in fluid communication with the liquid-distribution structure, and being in direct fluid communication with an evaporation interface defined between the liquid-distribution structure and the vapor barrier wall;

a condenser including a vapor inlet and a liquid outlet;

a vapor line providing fluid communication between the vapor removal channel of the evaporator and the vapor inlet of the condenser; and a liquid line providing fluid communication between the liquid inlet port of the evaporator and the liquid outlet of the condenser.

42. The heat transfer system of claim 41, further comprising a reservoir in fluid communication with the liquid line.

43. The heat transfer system of claim 41, wherein the evaporator includes a fluid outlet port coupled through the outer fluid enclosure, and the heat transfer system further comprises a secondary system coupled to the evaporator at least through a sweepage line that couples to the fluid outlet port.

44. The heat transfer system of claim 43, wherein the fluid outlet port is in fluid communication with the wick.

45. The heat transfer system of claim 43, wherein the secondary system includes a secondary evaporator and a reservoir.

* * * * *

UNITED STATES PATENT AND TRADEMARK OFFICE

CERTIFICATE OF CORRECTION

PATENT NO. : 7,931,072 B1
APPLICATION NO. : 11/383740
DATED : April 26, 2011
INVENTOR(S) : Kroliczek et al.

It is certified that error appears in the above-identified patent and that said Letters Patent is hereby corrected as shown below:

In the specification:

| | | |
|---|---|---|
| COLUMN 10, | LINE 9, | change “about 2 um” to --about 2 μm-- |
| COLUMN 13, | LINE 35, | change “cylinder.Alternatively,” to --cylinder. Alternatively,-- |

In the claims:

| | | | |
|---|---|---|---|
| CLAIM 40, | COLUMN 18, | LINE 15, | change “the first” to --the at least one-- |
| CLAIM 41, | COLUMN 18, | LINE 33, | change “port; a sealing” to --port; a sealing-- |

Signed and Sealed this
Seventeenth Day of September, 2013

Teresa Stanek Rea

Teresa Stanek Rea
*Deputy Director of theUnited States Patent and Trademark Office*